US012680765B2

(12) United States Patent
Horiuchi

(10) Patent No.: US 12,680,765 B2
(45) Date of Patent: Jul. 14, 2026

(54) LATENT HEAT STORAGE

(71) Applicant: SHINKO ELECTRIC INDUSTRIES CO., LTD., Nagano (JP)

(72) Inventor: Michio Horiuchi, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 218 days.

(21) Appl. No.: 18/310,900

(22) Filed: May 2, 2023

(65) Prior Publication Data

US 2023/0384041 A1 Nov. 30, 2023

(30) Foreign Application Priority Data

May 24, 2022 (JP) ..... 2022-084748

(51) Int. Cl.
*F28D 20/02* (2006.01)
*F28D 20/00* (2006.01)

(52) U.S. Cl.
CPC ..... *F28D 20/021* (2013.01); *F28D 20/0056* (2013.01)

(58) Field of Classification Search
CPC .... F28D 20/02; F28D 20/021; F28D 20/0056; F28D 2020/0078; F28D 17/02; C09K 5/063; C04B 35/00; F24H 7/00; F24H 7/02; F24H 7/04
See application file for complete search history.

(56) References Cited

U.S. PATENT DOCUMENTS 3,803,441 A * 4/1974 Ohsawa ..... H01J 1/24 313/340
4,873,038 A 10/1989 Rapp et al.
2004/0197090 A1* 10/2004 Kudo ..... F28D 20/02 392/341
2005/0279292 A1* 12/2005 Hudson ..... F24H 7/0416 122/32
2006/0051112 A1* 3/2006 Matsusaka ..... G03G 15/5004 399/88
2013/0152917 A1* 6/2013 Couturier ..... F24S 60/10 126/674
2017/0044415 A1 2/2017 Akiyama et al.
2017/0146262 A1* 5/2017 Weimer ..... F24S 20/40
2019/0310026 A1* 10/2019 Chopard ..... F28F 3/046
2020/0107877 A1* 4/2020 Koblish ..... A61B 5/287
(Continued)

FOREIGN PATENT DOCUMENTS

CN 206682949 U 11/2017
CN 112111250 12/2020
(Continued)

OTHER PUBLICATIONS

Sheng Nan et al: "Macro-encapsulated metallic phase change material over 1000 for high-temperature thermal storage", Solar Energy Materials and Solar Cells, Elsevier Science Publishers, Amsterdam, NL, vol. 239, Feb. 21, 2022, XP086991490.
(Continued)

*Primary Examiner* — Harry E Arant
(74) *Attorney, Agent, or Firm* — IPUSA, PLLC

(57) ABSTRACT

A latent heat storage includes a ceramic part, formed of a polycrystalline material, and including a closed space famed therein, and a metal part provided inside the closed space, and including copper.

20 Claims, 20 Drawing Sheets

(56) References Cited

U.S. PATENT DOCUMENTS

| | | | | |
|---|---|---|---|---|
| 2022/0214118 | A1 | 7/2022 | Macnaghten | |
| 2023/0086892 | A1* | 3/2023 | Robertson | F28D 20/0056 219/201 |
| 2023/0140947 | A1* | 5/2023 | Kraft | F28D 20/021 165/104.17 |

FOREIGN PATENT DOCUMENTS

| | | | |
|---|---|---|---|
| JP | H02-242046 | | 9/1990 |
| JP | H11264683 | A * | 9/1999 |
| JP | 2012-111825 | | 6/2012 |
| JP | 2012229159 | A * | 11/2012 |
| JP | 2015-048393 | | 3/2015 |
| JP | 2019-173017 | | 10/2019 |
| JP | 2021031507 | A * | 3/2021 |
| WO | 2013/061978 | | 5/2013 |

OTHER PUBLICATIONS

Extended European search report dated Oct. 10, 2023 issued with respect to the corresponding European patent application No. 23173600.0.

Nobuhiro Maruoka et al., "Development of PCM for Recovering High Temperature Waste Heat and Utilization for Producing Hydrogen by Reforming Reaction of Methane", ISIJ International, vol. 42 (2002), No. 2, pp. 215-219.

Huibin Li et al., "Numerical analysis of thermal energy charging performance of spherical Cu@Cr@Ni phase-change capsules for recovering high-temperature waste heat", Journal of Materials Research 2017, pp. 1-11.

Kin Zhou et al., "Encapsulated Copper-Based Phase-Change Materials for High-Temperature Heat Storage", ACS Omega 2022, 7, pp. 5442-5452.

Office Action mailed on Feb. 3, 2026 issued with respect to the corresponding Japanese patent application No. 2022-084749.

Qinglin Li et al., "Preparation of a new capsule phase change material for high temperature thermal energy storage", Journal of Alloys and Compounds, vol. 868, 2021, 159179, pp. 1-8.

J. W. McMurray et al., "Ceramic encapsulated metal phase change material for high temperature thermal energy storage", Applied Thermal Engineering, vol. 170, 2020, 115003, pp. 1-8.

Office Action mailed on Feb. 27, 2025 with respect to the related U.S. Appl. No. 18/310,932.

Office Action mailed on Jul. 15, 2025 with respect to the related U.S. Appl. No. 18/310,932.

Office Action mailed on Sep. 24, 2025 with respect to the related U.S. Appl. No. 18/310,932.

Office Action mailed on Jan. 14, 2026 with respect to the related U.S. Appl. No. 18/310,932.

Extended European search report mailed on Oct. 10, 2023 with respect to the related European patent application No. 23174382.4.

Office Action mailed on Apr. 14, 2026 with respect to the related Japanese patent application No. 2022-084749.

Office Action mailed on Apr. 14, 2026 with respect to the corresonding Japanese patent application No. 2022-084748.

* cited by examiner

LATENT HEAT STORAGE

CROSS-REFERENCE TO RELATED APPLICATIONS

This application is based upon and claims priority to Japanese Patent Application No. 2022-084748, filed on May 24, 2022, the entire contents of which are incorporated herein by reference.

FIELD

Certain aspects of the embodiments discussed herein are related to latent heat storages, and methods for manufacturing latent heat storages.

BACKGROUND

Conventionally, a latent heat storage has been proposed using copper as a phase change material (PCM), and having the PCM enclosed by a nickel or chromium protective layer.

Related art includes Japanese Laid-Open Patent Publication No. 2019-173017 (now Japanese Patent No. 6967790), International Publication Pamphlet No. WO 2013/061978 (now Japanese Patent No. 6057184), Japanese Laid-Open Patent Publication No. 2012-111825, Nobuhiro Maruoka et al., "Development of PCM for Recovering High Temperature Waste Heat and Utilization for Producing Hydrogen by Reforming Reaction of Methane", ISIJ International, Vol. 42 (2002), No. 2, pp. 215-219, and Huibin Li et al., "Numerical analysis of thermal energy charging performance of spherical Cu@Cr@Ni phase-change capsules for recovering high-temperature waste heat", Journal of Materials Research 2017, pp. 1-11, for example.

The latent heat storage is used under high-temperature conditions. In the conventional latent heat storage having the PCM enclosed by the nickel or chromium protective layer, a change in properties occurs in the protective layer during use. In a case where an oxidizable gas, such as air or the like, is used as a heating medium, for example, the protective layer becomes oxidized. Particularly in a case where impurities, such as inorganic salt or the like, is present in an ambient environment of use, the oxidation of the protective layer easily progresses. However, such a change in properties of the protective layer may shorten a life cycle of the latent heat storage.

SUMMARY

Accordingly, it is an object in one aspect of the embodiments to provide a latent heat storage capable improving stability, and a method for manufacturing the latent heat storage.

According to one aspect of the embodiments, a latent heat storage includes a ceramic part, formed of a polycrystalline material, and including a closed space formed therein; and a metal part provided inside the closed space, and including copper.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

DESCRIPTION OF EMBODIMENTS

Figure 1A:
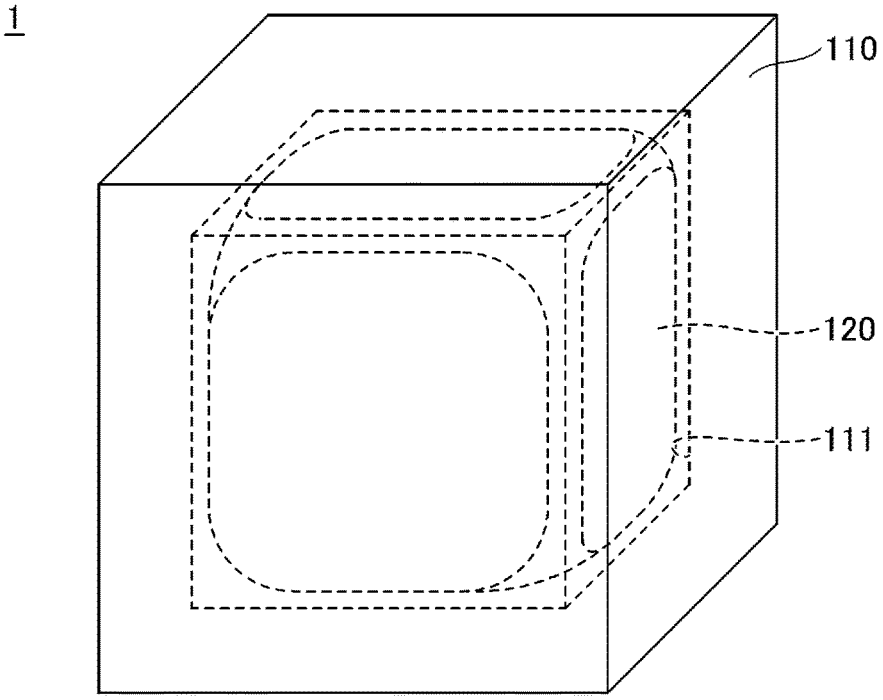
FIG. 1A and FIG. 1B are diagrams illustrating an example of a latent heat storage according to a first embodiment.

Preferred embodiments of the present invention will be described with reference to the accompanying drawings. In the drawings, those constituent elements having substantially the same functional configuration are designated by the same reference numerals, and a repeated description of such constituent elements may be omitted.

First Embodiment

Figure 1B:
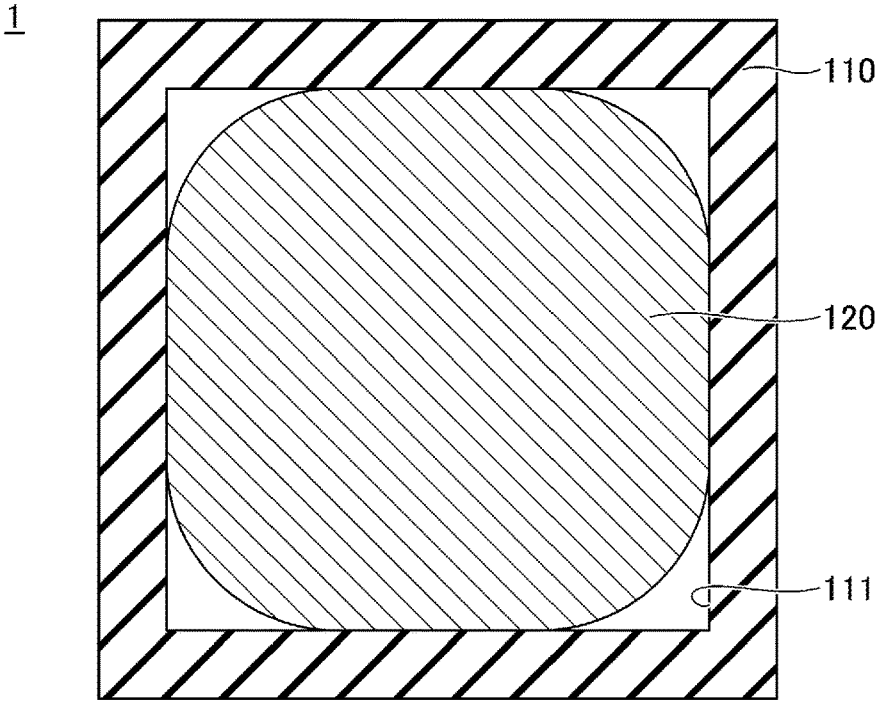

A first embodiment described hereunder relates to a latent heat storage. FIG. 1A and FIG. 1B are diagrams illustrating an example of the latent heat storage according to the first embodiment. FIG. 1A is a perspective view of the latent heat storage, and FIG. 1B is a cross sectional view of the latent heat storage.

As illustrated in FIG. 1A and FIG. 1B, a latent heat storage 1 according to the first embodiment includes a ceramic part 110 famed of a polycrystalline material, and a metal part 120.

A closed space 111 is famed inside the ceramic part 110. The ceramic part 110 and the closed space 111 have a rectangular parallelepiped shape. The ceramic part 110 is integrally formed, for example. For example, the ceramic part 110 does not have a bonding portion in the closed space 111, bonding two ceramic pieces with opposing cavities, for example. In the present specification, "does not have a bonding portion" refers to a state where there is no discontinuity in both composition and microstructure, that is, the composition is not discontinuous (no bonding material is used to bond two different compositions) and the microstructure is not discontinuous (no later introduced portion of the same kind of material is present). The ceramic part 110 includes aluminum oxide at a proportion greater than or equal to 90 mass %, or mullite at a proportion greater than or equal to 90 mass %, or aluminum nitride at a proportion greater than or equal to 95 mass %, or a mixture of aluminum nitride and boron nitride at a proportion greater than or equal to 95 mass %, for example. That is, the ceramic part 110 may be famed of aluminum oxide having a purity greater than or equal to 90 mass %, or mullite having a purity greater than or equal to 90 mass %, or aluminum nitride having a purity greater than or equal to mass %, or a mixture of aluminum nitride and boron nitride having a purity greater than or equal to 95 mass %.

The metal part 120 is provided inside the closed space 111. In other words, the metal part 120 is sealed by the ceramic part 110. That is, the metal part 120 is covered airtight by the ceramic part 110 that is a continuous body. The metal part 120 includes copper. For example, a main component of the metal part 120 is copper. The metal part 120 includes copper at a proportion greater than or equal to 99 mass %, for example. That is, the metal part 120 may be famed of copper having a purity greater than or equal to 99 mass %.

A volume of the closed space 111 is preferably larger than a volume of the metal part 120. This is because, as will be described later, the metal part 120 undergoes a phase change from solid to liquid during use of the latent heat storage 1, and the metal part 120 expands during this phase change. In addition, in a case where the main component of the metal part 120 is copper, the metal part 120 expands by approximately 12 volume % during the phase change. Accordingly, at 25° C., the volume of the closed space 111 is more preferably greater than or equal to 112% of the volume of the metal part 120. In a case where the volume of the closed space 111 is excessively large with respect to the volume of the metal part 120, not only does the ceramic part 110 become unnecessarily large, but a thermal resistance between the ceramic part 110 and the metal part 120 also becomes large. Accordingly, at 25° C., the volume of the closed space 111 is more preferably less than or equal to 120% of the volume of the metal part 120. In the case where the main component of the metal part 120 is copper, the metal part 120 thermally expands at a rate of approximately 17 ppm/° C. during a time period in which a temperature reaches a melting point from 25° C., but the ceramic part 110 can withstand a thermal stress caused by the thermal expansion of the metal part 120 to such an extent.

In a case where the volume of the closed space 111 is larger than the volume of the metal part 120, a gap is famed between an outer surface of the metal part 120 and an inner surface of the closed space 111. The gap between the outer surface of the metal part 120 and the inner surface of the closed space 111 may be present at only one location, or may be present at a plurality of locations.

The melting point of copper is 1084.5° C. In the case where the main component of the metal part 120 is copper, the phase change between solid and liquid occurs at approximately 1084.5° C. At such a temperature, the ceramic part 110 formed of the polycrystalline material is chemically stable. Accordingly, regardless of whether the metal part 120 is solid or liquid, the ceramic part 110 can keep the metal part 120 confined in the closed space 111. In addition, even when the latent heat storage 1 is used at a high temperature, a chemical change, such as oxidation or the like, is less likely to occur in the ceramic part 110.

According to the latent heat storage 1, a high thermal conductivity can be obtained, because the metal part 120 functions as a phase change material (PCM). In addition, even when the latent heat storage 1 is used at the high temperature, a change in properties, such as oxidation or the like, is less likely to occur in the ceramic part 110. Accordingly, a stability of the latent heat storage 1 can be improved. For this reason, an oxidizable gas, such as air or the like, can be used as a heating medium, and a selectable range of the heating medium can be increased.

Further, the surface of the latent heat storage 1 can be easily cleaned. For example, in a case where the heating medium is an exhaust gas of a combustion furnace including an unburned component, the heating medium may include a substance, such as soot or the like, that easily adheres to the latent heat storage 1. The adhesion of such a substance to the latent heat storage 1 may cause a decrease in thermal conductivity and an increase in flow resistance. On the other hand, in the latent heat storage 1, the adhered substance can be easily removed by an atmospheric high-temperature treatment or the like. In a case where the adhered substance is inorganic, the adhered substrate can be removed by acid washing or the like.

Figure 2A:
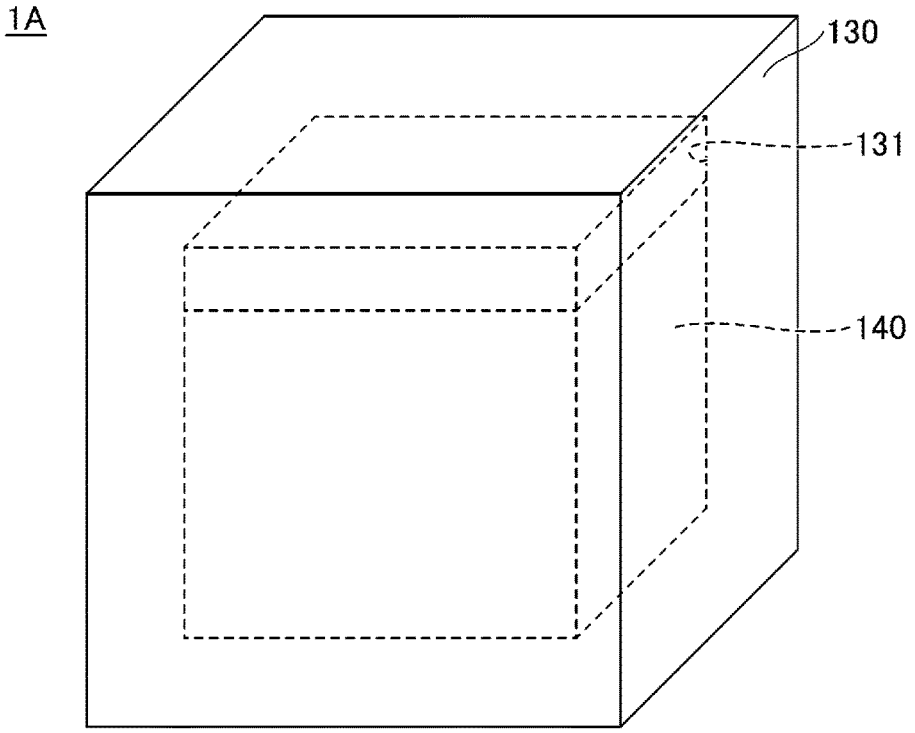
FIG. 2A and FIG. 2B are diagrams illustrating an example of a method for manufacturing the latent heat storage according to the first embodiment.
Figure 2B:
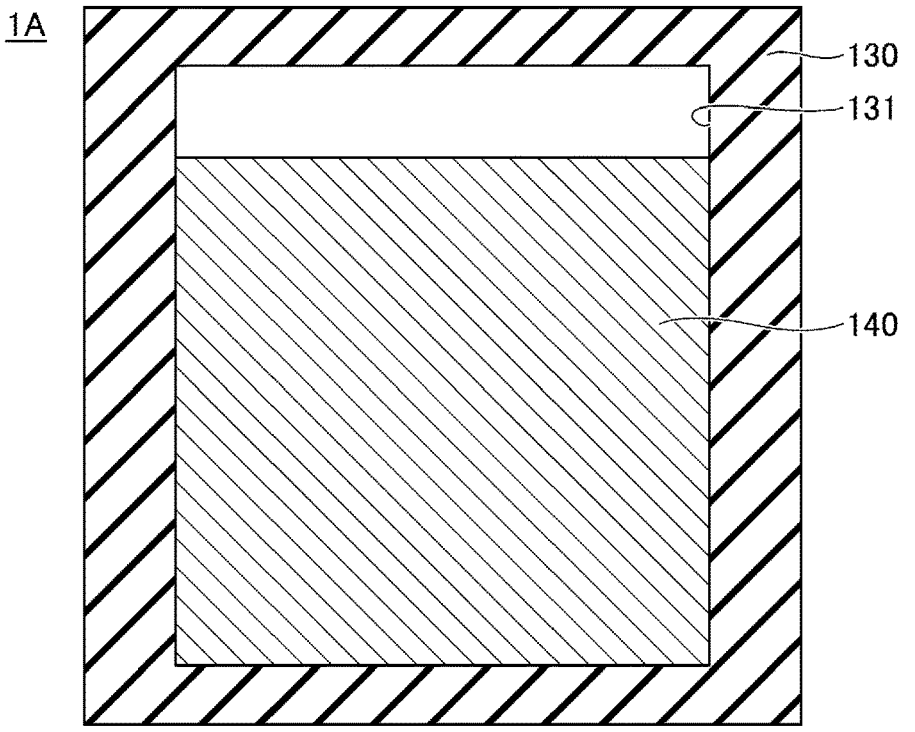

Next, a method for manufacturing the latent heat storage 1 according to the first embodiment will be described. FIG. 2A and FIG. 2B are diagrams illustrating an example of the method for manufacturing the latent heat storage 1 according to the first embodiment. FIG. 2A is a perspective view of the latent heat storage 1, and FIG. 2B is a cross sectional view of the latent heat storage 1.

First, as illustrated in FIG. 2A and FIG. 2B, a complex body 1A, having an unfired ceramic part 130 and an unfired metal part 140, is prepared. The metal part 140 is covered with the ceramic part 130. At a later stage, the ceramic part 130 becomes the ceramic part 110, and the metal part 140 becomes the metal part 120.

The ceramic part 130 is a cold isostatic pressing (CIP) compact after preforming one of a green sheet laminate, a slip cast body, a gel cast body, and a granulated powder, including the material of the ceramic part 110, for example. The ceramic part 130 includes aluminum oxide at a proportion greater than or equal to 90 mass %, or mullite at a proportion greater than or equal to mass %, or aluminum nitride at a proportion greater than or equal to 95 mass %, or a mixture of aluminum nitride and boron nitride at a proportion greater than or equal to 95 mass %, for example. The ceramic part 130 may further include a sintering aid or the like. Examples of the sintering aid include silicon, magnesium, calcium, or the like. A grain diameter (or grain size) of ceramic grains included in the ceramic part 130 is preferably less than or equal to 1 μm, and more preferably less than or equal to 0.3 μm.

The metal part 140 is a CIP compact after preforming one of a wire rod, a strut or post material, a paste, a slip cast body, a gel cast body, and a granulated powder, including copper, for example. The metal part 140 includes copper at a proportion greater than or equal to 99 mass %, for example.

A closed space 131 is famed inside the ceramic part 130, and the metal part 260 is provided inside the closed space 131. A volume of the closed space 131 is larger than a volume of the metal part 140, and a gap is formed between an outer surface of the metal part 140 and an inner surface of the closed space 131.

Next, the ceramic part 130 and the metal part 140 are fired simultaneously. As a result, the ceramic part 110 is formed from the ceramic part 130, and the metal part 120 is formed from the metal part 140 (refer to FIG. 1A and FIG. 1B). In this state, a densification of the porous, ceramic part 130 occurs, and a relative density of the ceramic part 110 formed of the polycrystalline material becomes approximately 95% to approximately 99%. On the other hand, a densification of the metal part 140 hardly occurs, and a relative density of the metal part 120 is approximately 100%. Accordingly, the relative densities of the ceramic part 130 and the metal part 140 are preferably determined by taking into consideration a difference that occurs between changes in the relative densities caused by the firing. In the present disclosure, when firing the ceramic part, the metal part is fired even in a case where a change other than the phase change, such as a change in components, properties, or the like, does not occur in the metal part, and the firing of the ceramic part and the firing of the metal part may be performed simultaneously by co-firing. The relative density refers to a density relative to a density in a solid bulk state. In other words, the relative density refers to a density with respect to a density in a solid bulk state. In other words, the relative density refers to a proportion of a density of a comparative object, with respect to a density in a state where no voids or defects are present.

A co-firing temperature is a predetermined temperature higher than the melting point of the metal part 140, where the predetermined temperature is in a range higher than or equal to 100° C. and lower than or equal to 900° C., for example. A rate of temperature increase during the co-firing is in a range greater than or equal to 5° C./minute and less than or equal to 15° C./minute, for example. A co-firing environment may either be a reducing atmosphere including a reducing gas, such as hydrogen or the like, or a non-oxidizable atmosphere including a non-oxidizable gas, such as nitrogen or the like, for example.

The latent heat storage 1 according to the first embodiment can be manufactured as described above.

In a case where the ceramic part 130 includes aluminum oxide at a proportion greater than or equal to 90 mass %, or mullite at a proportion greater than or equal to 90 mass %, or aluminum nitride at a proportion greater than or equal to 95 mass %, or a mixture of aluminum nitride and boron nitride at a proportion greater than or equal to 95 mass % (hereinafter also referred to as "a case where the ceramic part 130 has a predetermined composition"), it is particularly easy to reduce or control a reaction between the material used for the ceramic part 130 and the material used for the metal part 140 during the co-firing of the ceramic part 130 and the metal part 140.

In addition, in the case where the ceramic part 130 has a predetermined composition, it is particularly easy to reduce or control a diffusion of the melted metal part 140 into the ceramic part 130. For example, the melting point of the metal part 140 is lower than the temperature at which the densification of the ceramic part 130 occurs, and the metal part 140 melts before the densification of the ceramic part 130 occurs. When the melted metal part 140 diffuses into the ceramic part 130 before the densification, the densification of the ceramic part 130 may be inhibited to no longer form the closed space 111, or the melted metal part 140 may flow outside the ceramic part 130. But when the ceramic part 130 has the predetermined composition, it is particularly easy to reduce such a phenomenon in advance.

Moreover, in the case where the ceramic part 130 has the predetermined composition, even when a portion of the melted metal part 140 evaporates, it is particularly easy to reduce the diffusion of the evaporated component into the ceramic part 130. When the metal part 140 melts, a portion thereof evaporates inside the closed space 131. If the evaporated component diffuses into the ceramic part 130 before the densification, the densification of the ceramic part 130 may be inhibited to no longer form the closed space 111, or the evaporated component may diffuse outside the ceramic part 130. But when the ceramic part 130 has the predetermined composition, it is particularly easy to reduce such a phenomenon in advance.

In order to make the volume of the closed space 111 larger than the volume of the metal part 120 in a case where the metal part 140 is one of a paste, a slip cast body, a gel cast body, and a CIP compact, for example, the relative density of the metal part 140 before the firing is preferably adjusted to be low. In addition, in order to make the volume of the closed space 111 larger than the volume of the metal part 120 in a case where the metal part 140 is a wire rod or a strut or post material, an organic component that disappears during the firing is preferably provided on a surface of the wire rod or the strut or post material, for example. Ethyl cellulose, polyvinyl alcohol, polyvinyl butyral, polymethacrylate, or the like are preferably used for such an organic component. Because the temperature at which the densification of the ceramic part 130 occurs is higher than the temperature at which the organic component disappears and higher than the melting point of the metal part 140, the densification of the ceramic part 130 will not be inhibited.

In order to increase a heat exchange efficiency between the metal part 120 and the heating medium, the ceramic part 110 is preferably thin. On the other hand, at the time of the co-firing, because the melted metal part 140 tends to approach a spheroid, a force may be applied from the melted metal part 140 to the ceramic part 130. For this reason, when the ceramic part 130 is made thin, the ceramic part 130 may become deformed. Hence, in order to reduce the defamation of the ceramic part 130 in advance, a titanium oxide powder is preferably provided on the outer surface of the metal part 140 before the co-firing. The titanium oxide powder can be mixed into the paste or the organic component, for example. The titanium oxide may either be anatase or rutile. At the time of the co-firing, titanium included in titanium oxide is mainly interposed between the outer surface of the metal part 140 and the inner surface of the ceramic part 130, to reduce the deformation (spheroidizing) of the metal part 140. In the latent heat storage 1 manufactured using the co-firing, titanium is present between the metal part 120 and the ceramic part 110. A mass of titanium is in a range greater than 0% and less than or equal to 10% of the mass of the metal part 120.

Second Embodiment

Figure 3A:
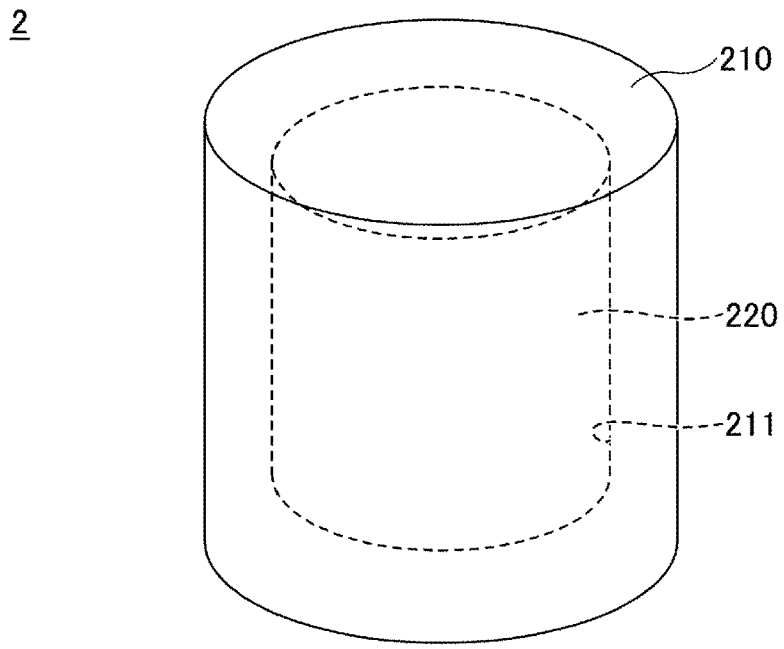
FIG. 3A and FIG. 3B are diagrams illustrating an example of the latent heat storage according to a second embodiment.
Figure 3B:
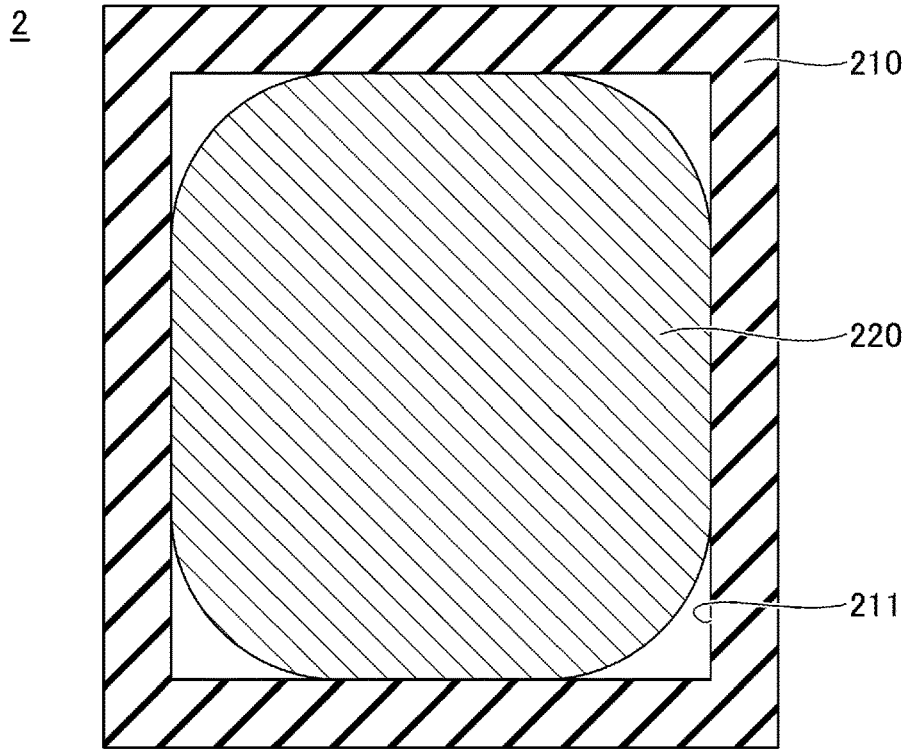

A second embodiment described hereunder relates to a latent heat storage. FIG. 3A and FIG. 3B are diagrams illustrating an example of the latent heat storage according to the second embodiment. FIG. 3A is a perspective view of the latent heat storage, and FIG. 3B is a cross sectional view of the latent heat storage.

As illustrated in FIG. 3A and FIG. 3B, a latent heat storage 2 according to the second embodiment includes a ceramic part 210 formed of a polycrystalline material, and a metal part 220.

A closed space 211 is famed inside the ceramic part 210. The ceramic part 210 and the closed space 211 have a cylindrical shape. The ceramic part 210 is integrally formed, for example. For example, the ceramic part 210 does not have a bonding portion in the closed space 211, bonding two ceramic pieces with opposing cavities, for example. The ceramic part 210 is formed of a material similar to the material used for the ceramic part 110.

The metal part 220 is provided inside the closed space 211. In other words, the metal part 220 is sealed by the ceramic part 210. That is, the metal part 220 is covered airtight with the ceramic part 210 that is a continuous body. The metal part 220 is formed of a material similar to the material used for the metal part 120.

A volume of the closed space 211 is preferably larger than a volume of the metal part 220. In a case where the volume of the closed space 211 is larger than the volume of the metal part 220, a gap is formed between the outer surface of the metal part 220 and the inner surface of the closed space 211, although the illustration of this gap is omitted in FIG. 3A. The gap between the outer surface of the metal part 220 and the inner surface of the closed space 211 may be present at only one location, or may be present at a plurality of locations.

Otherwise, the configuration of the second embodiment is similar to that of the first embodiment. The latent heat storage 2 according to the second embodiment can be manufactured by a method similar to that used for the first embodiment, except for the shape of the latent heat storage 2 that is different from the shape of the latent heat storage 1.

According to the second embodiment, it is possible to obtain effects similar to those obtainable by the first embodiment. In addition, because the stress applied to the ceramic part 210 from the outside is easily distributed, a higher durability can be achieved.

The latent heat storage may have a spherical shape, a prismatic or rectangular column shape, or the like.

Third Embodiment

Figure 4A:
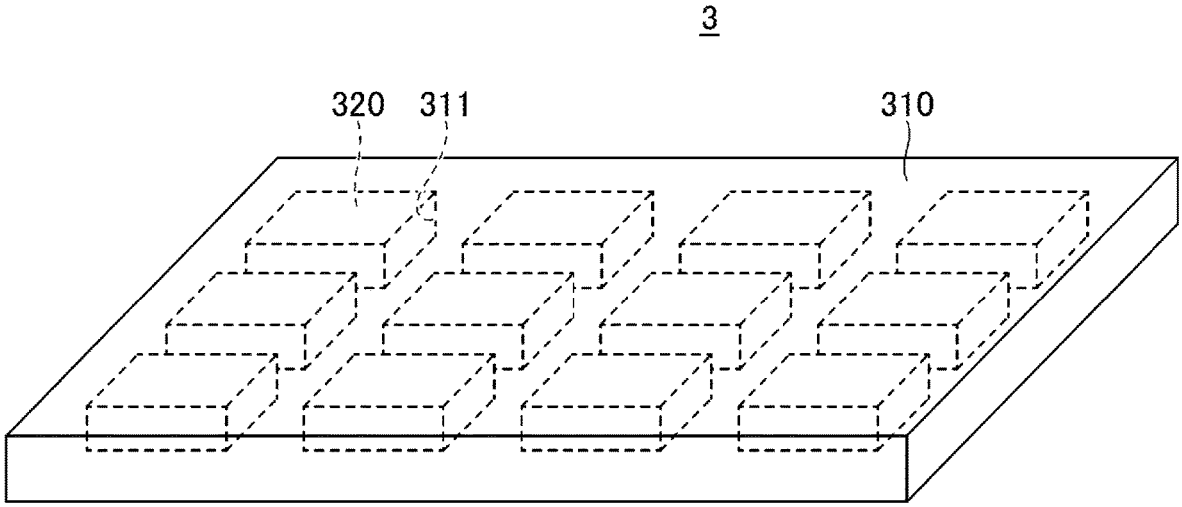
FIG. 4A and FIG. 4B are diagrams illustrating an example of the latent heat storage according to a third embodiment.
Figure 4B:
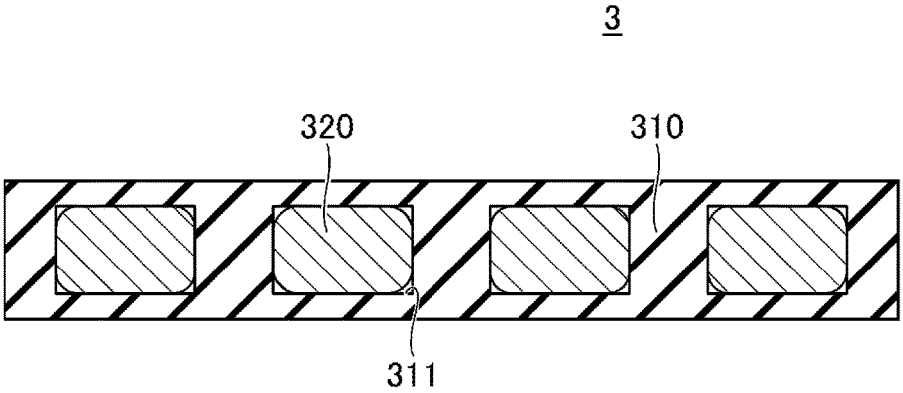

A third embodiment described hereunder relates to a latent heat storage. FIG. 4A and FIG. 4B are diagrams illustrating an example of the latent heat storage according to the third embodiment. FIG. 4A is a perspective view of the latent heat storage, and FIG. 4B is a cross sectional view of the latent heat storage.

As illustrated in FIG. 4A and FIG. 4B, a latent heat storage 3 according to the third embodiment includes a ceramic part 310 formed of a polycrystalline material, and a plurality of metal parts 320.

A plurality of closed spaces 311 is formed inside the ceramic part 310. The ceramic part 310 and the closed spaces 311 have a rectangular parallelepiped shape. The ceramic part 310 is integrally famed, for example. For example, the ceramic part 310 does not have a bonding portion in the closed space 311, bonding two ceramic pieces with opposing cavities, for example. The ceramic part 310 is formed of a material similar to the material used for the ceramic part 110. The plurality of closed spaces 311 is arranged at equal intervals in two mutually perpendicular directions on a plane that is parallel to a pair of parallel surfaces of the ceramic part 310.

One metal part 320 is provided inside each of the plurality of closed spaces 311. In other words, the metal parts 320 are sealed by the ceramic part 310. That is, the metal parts 320 are covered airtight with the ceramic part 310 that is a continuous body. The metal parts 320 are formed of a material similar to the material used for the metal part 120.

A volume of the closed space 311 is preferably larger than the volume of the metal part 320. In a case where the volume of the closed space 311 is larger than the volume of the metal part 320, a gap is formed between an outer surface of the metal part 320 and an inner surface of the closed space 311, although the illustration of this gap is omitted in FIG. 4A. The gap between the outer surface of the metal part 320 and the inner surface of the closed space 311 may be present at only one location, or may be present at a plurality of locations.

Otherwise, the configuration of the third embodiment is similar to that of the first embodiment.

Figure 5A:
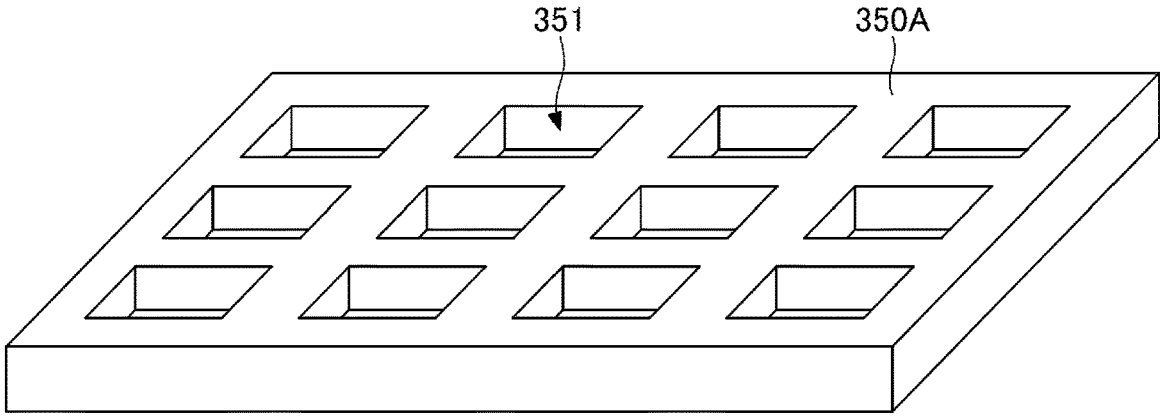
FIG. 5A, FIG. 5B, and FIG. 5C are diagrams illustrating an example of the method for manufacturing the latent heat storage according to the third embodiment.
Figure 5B:
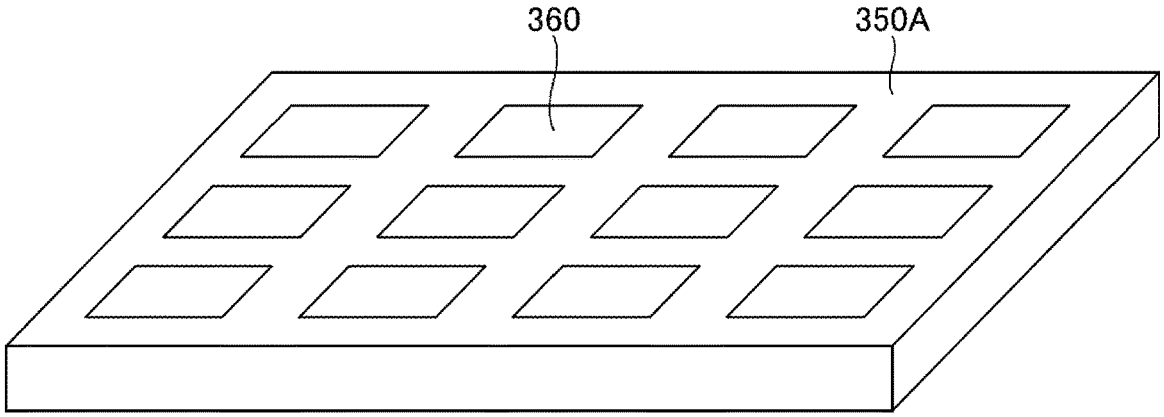
Figure 5C:
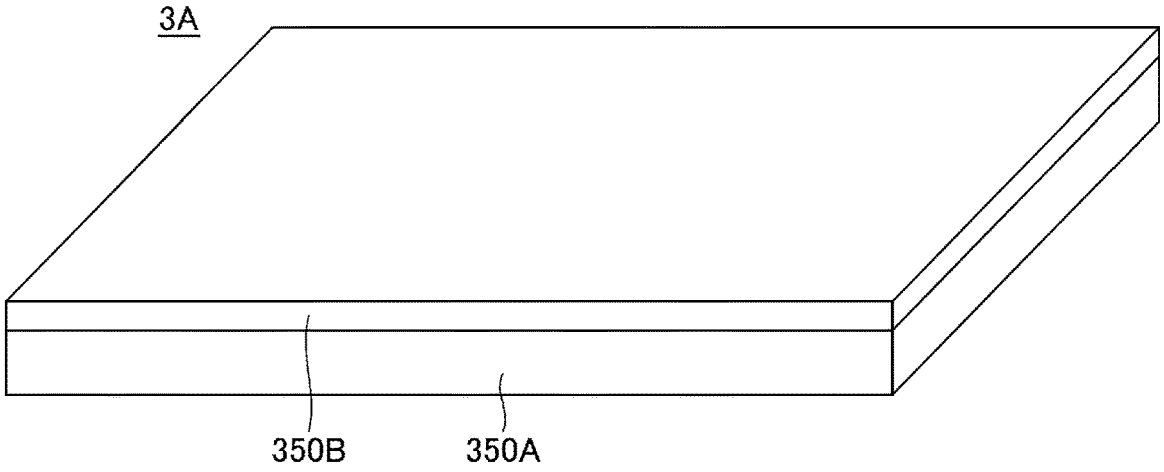

Next, a method for manufacturing the latent heat storage 3 according to the third embodiment will be described. FIG. 5A, FIG. 5B, and FIG. 5C are diagrams illustrating an example of the method for manufacturing the latent heat storage 3 according to the third embodiment.

First, as illustrated in FIG. 5A, an unfired ceramic part 350A, formed with a plurality of cavities 351 that becomes the closed spaces 311, is prepared. The unfired ceramic part 350A is a green sheet laminate in which a plurality of green sheets is laminated, for example. The unfired ceramic part 350A may also be formed by injection molding or the like. The unfired ceramic part 350A becomes a part of the ceramic part 310 at a later stage.

Next, as illustrated in FIG. 5B, a metal part 360 is provided in each of the plurality of cavities 351. The metal part 360 becomes the metal part 320 at a later stage. The metal part 360 is a paste, a bead, a winding, or a sheet, for example.

Next, as illustrated in FIG. 5B, a sheet ceramic part 350B is provided on the unfired ceramic part 350A so as to close opening ends of the plurality of cavities 351. The ceramic part 350B becomes a part of the ceramic part 310 at a later stage.

Accordingly, as illustrated in FIG. 5C, a complex body 3A including the unfired ceramic part 350A, the sheet ceramic part 350B, and the metal parts 360 is obtained.

Next, the ceramic parts 350A and 350B and the metal parts 360 are fired simultaneously by co-firing. As a result, the ceramic part 310 is formed from the ceramic parts 350A and 350B, and the metal parts 320 are formed from the metal parts 360 (refer to FIG. 4A and FIG. 4B).

The latent heat storage 3 according to the third embodiment can be manufactured as described above.

According to the third embodiment, it is possible to obtain effects similar to those obtainable by the first embodiment.

Figure 6A:
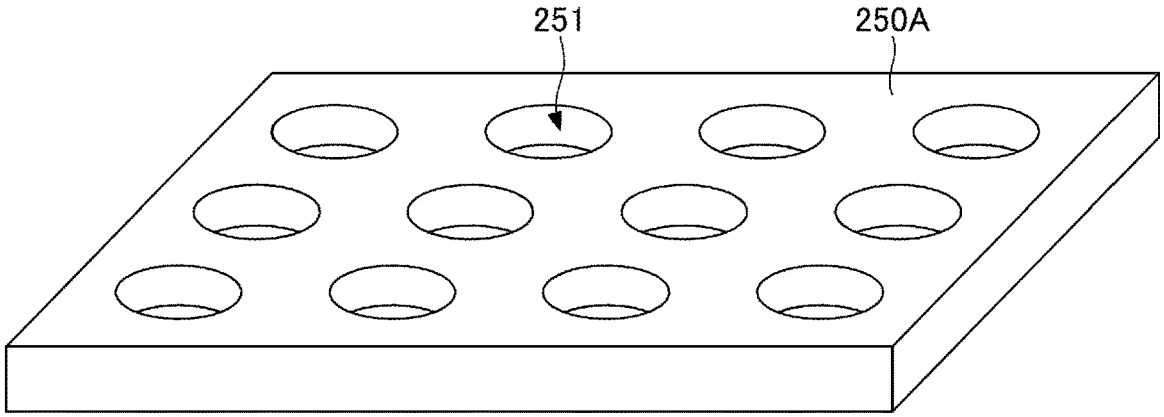
FIG. 6A, FIG. 6B, and FIG. 6C are diagrams illustrating an example of the method for manufacturing the latent heat storage according to the second embodiment.
Figure 6B:
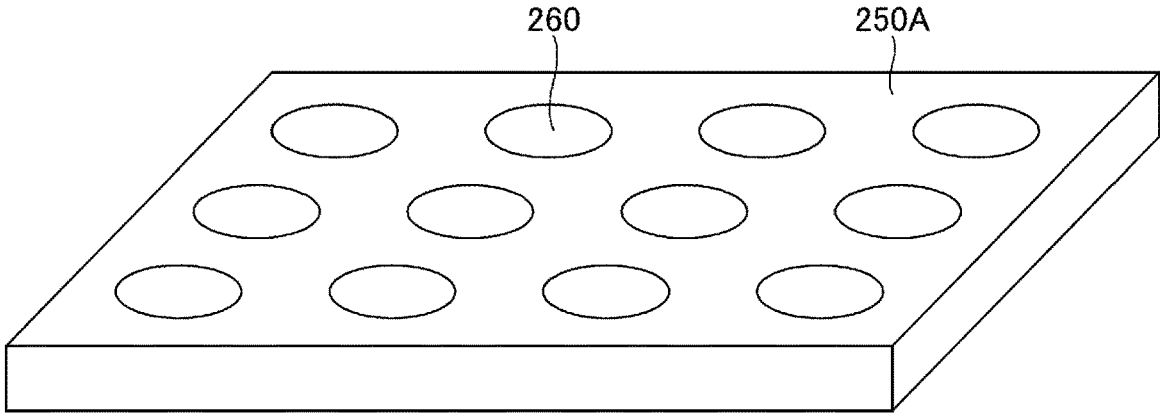
Figure 6C:
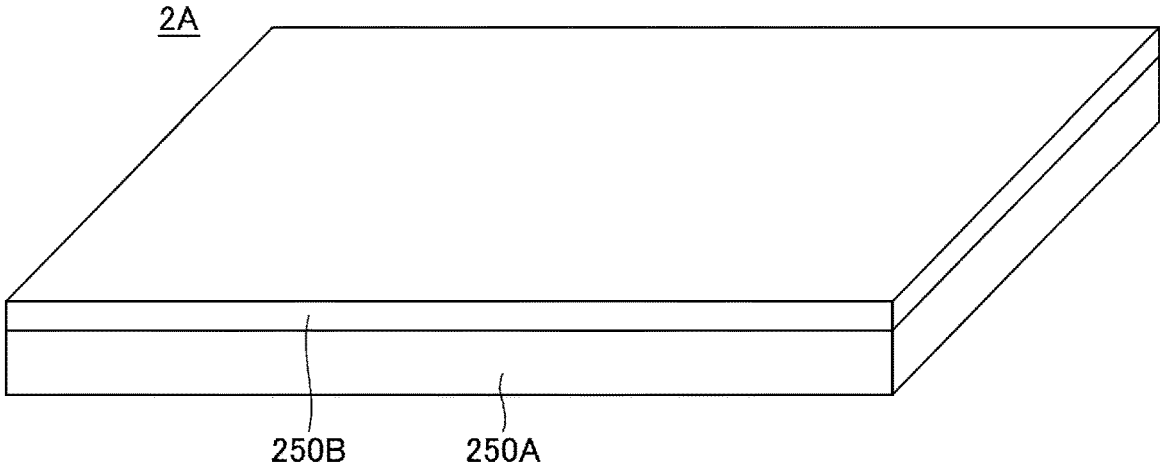

The complex body 3A may be divided or segmented for each of the metal parts 360 before firing the complex body 3A. In this case, the latent heat storage 1 according to the first embodiment can be obtained. The latent heat storage 2 according to the second embodiment can also be manufactured by a similar method. FIG. 6A, FIG. 6B, and FIG. 6C are diagrams illustrating an example of a method for manufacturing the latent heat storage 2 according to the second embodiment.

First, as illustrated in FIG. 6A, an unfired ceramic part 250A, formed with a plurality of cavities 251 that becomes the closed spaces 211, is prepared.

Next, as illustrated in FIG. 6B, a metal part 260 is provided in each of the plurality of cavities 251.

Next, as illustrated in FIG. 6C, a complex body 2A is obtained, by providing a sheet ceramic part 250B on the unfired ceramic part 250A so as to close opening ends of the plurality of cavities 251.

Next, the complex body 2A is divided or segmented for each of the metal parts 260. Then, the ceramic parts 250A and 250B and the metal part 260 are fired simultaneously by co-firing.

The latent heat storage 2 according to the second embodiment can also be manufactured by such a method.

The complex body used for manufacturing the latent heat storage may be manufactured by a dip coating method for ceramic slurry or the like.

Fourth Embodiment

Figure 7:
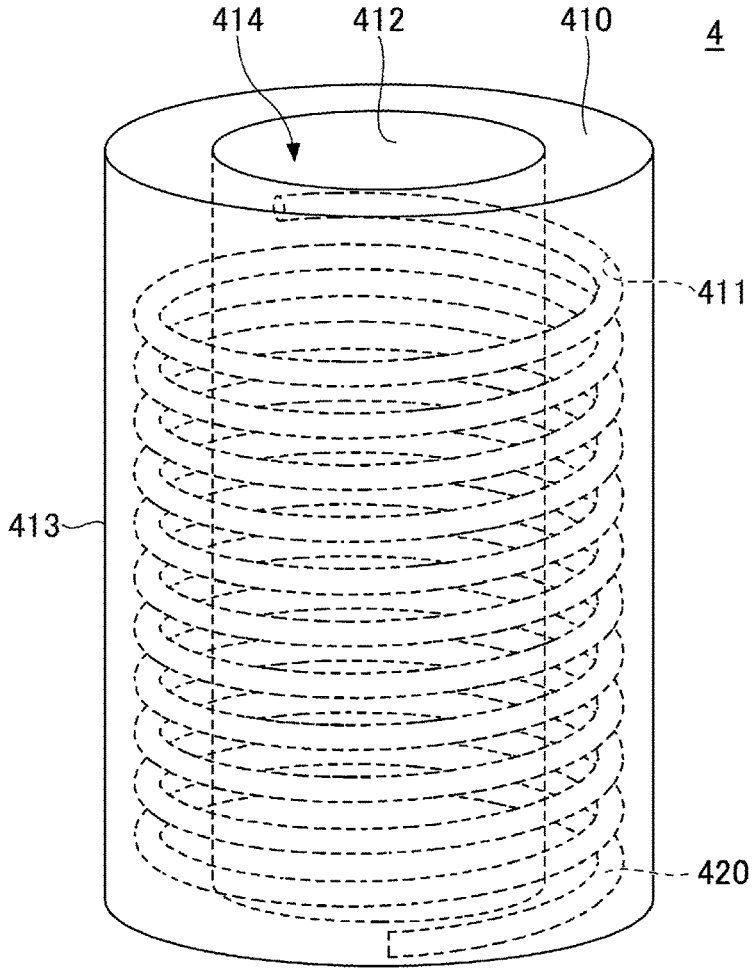
FIG. 7 is a perspective view illustrating an example of the latent heat storage according to a fourth embodiment.

A fourth embodiment described hereunder relates to a latent heat storage. FIG. 7 is a perspective view illustrating an example of the latent heat storage according to the fourth embodiment.

As illustrated in FIG. 7, the latent heat storage 4 according to the fourth embodiment includes a ceramic part 410 formed of a polycrystalline material, and a metal part 420.

The ceramic part 410 has a cylindrical shape with a through hole 414. The shape of the ceramic part 410 may be a rectangular tube shape including the through hole 414. The ceramic part 410 has a tubular shape including an inner wall surface 412 and an outer wall surface 413. A closed space 411 is formed inside the ceramic part 410. The closed space 411 has a spiral shape along the inner wall surface 412 and the outer wall surface 413. The ceramic part 410 is integrally famed, for example. For example, the ceramic part 410 does not have a bonding portion in the closed space 411, bonding two ceramic pieces with opposing cavities, for example. The ceramic part 410 is famed of a material similar to the material used for the ceramic part 110.

The metal part 420 is provided inside the closed space 411. In other words, the metal part 420 is sealed by the ceramic part 410. That is, the metal part 420 is covered airtight with the ceramic part 410 that is a continuous body. The metal part 420 has a spiral shape along the inner wall surface 412 and the outer wall surface 413. The metal part 420 is formed of a material similar to the material used for the metal part 120.

A volume of the closed space 411 is preferably larger than a volume of the metal part 420. In a case where the volume of the closed space 411 is larger than the volume of the metal part 420, a gap is formed between an outer surface of the metal part 420 and an inner surface of the closed space 411, although the illustration of this gap is omitted in FIG. 7. The gap between the outer surface of the metal part 420 and the inner surface of the closed space 411 may be present at only one location, or may be present at a plurality of locations.

Otherwise, the configuration of the fourth embodiment is similar to that of the first embodiment. In addition, the latent heat storage 4 according to the fourth embodiment can be manufactured by a method similar to that used for the first embodiment, except for the shape of the latent heat storage 4 that is different from the shape of the latent heat storage 1.

According to the fourth embodiment, it is possible to obtain effects similar to those obtainable by the first embodiment. In addition, the through hole 414 can also be used as a flow path of the heating medium. In this case, it is easy to stabilize a flow rate and a flow velocity of the heating medium.

Fifth Embodiment

Figure 8:
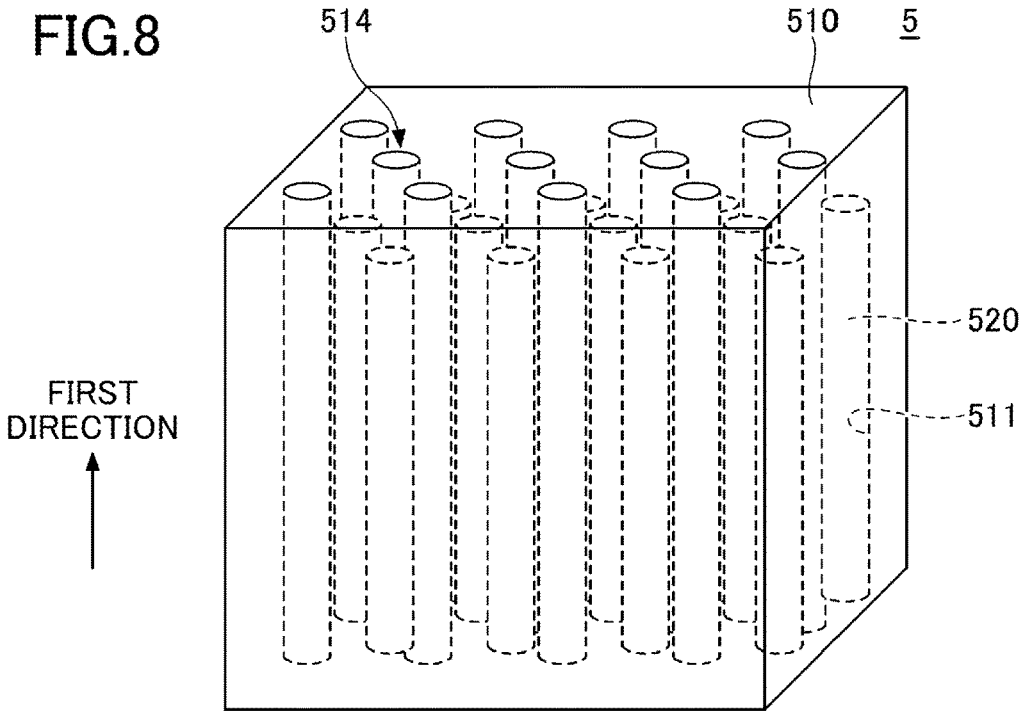
FIG. 8 is a perspective view illustrating an example of the latent heat storage according to a fifth embodiment.

A fifth embodiment described hereunder relates to a latent heat storage. FIG. 8 is a perspective view illustrating an example of the latent heat storage according to the fifth embodiment.

As illustrated in FIG. 8, a latent heat storage according to the fifth embodiment includes a ceramic part 510 formed of a polycrystalline material, and a plurality of metal parts 520.

A plurality of closed spaces 511 is formed inside the ceramic part 510. The ceramic part 510 has an approximately rectangular parallelepiped shape. A plurality of through holes 514, extending in a first direction, is formed in the ceramic part 510. The first direction is perpendicular to a pair of parallel surfaces of the ceramic part 510. Each of the plurality of closed spaces 511 has a cylindrical shape. The plurality of closed spaces 511 extends in the first direction. The plurality of closed spaces 511 is provided near the plurality of through holes 514. The ceramic part 510 is integrally formed, for example. For example, the ceramic part 510 does not have a bonding portion in the closed space 511, bonding two ceramic pieces with opposing cavities, for example. The ceramic part 510 is formed of a material similar to the material used for the ceramic part 110.

One metal part 520 is provided in each of the plurality of closed spaces 511. In other words, the metal parts 520 are sealed by the ceramic part 510. That is, the metal parts 520 are covered airtight with the ceramic part 510 that is a continuous body. The metal parts 520 have a columnar shape parallel to the first direction. The metal parts 520 are famed of a material similar to the material used for the metal part 120.

A volume of the closed space 511 is preferably larger than a volume of the metal part 520. In a case where the volume of the closed space 511 is larger than the volume of the metal part 520, a gap is formed between an outer surface of the metal part 520 and an inner surface of the closed space 511, although the illustration of this gap is omitted in FIG. 8. The gap between the outer surface of the metal part 520 and the inner surface of the closed space 511 may be present at only one location, or may be present at a plurality of locations.

Otherwise, the configuration of the fifth embodiment is similar to that of the first embodiment. The latent heat storage 5 according to the fifth embodiment can be manufactured by a method similar to that used for the first embodiment, except for the shape of the latent heat storage 5 that is different from the shape of the latent heat storage 1.

According to the fifth embodiment, it is possible to obtain effects similar to those obtainable by the first embodiment. In addition, the plurality of through holes 514 can also be used as a flow path of the heating medium. In this case, it is easy to stabilize the flow rate and the flow velocity of the heating medium.

Figure 9A:
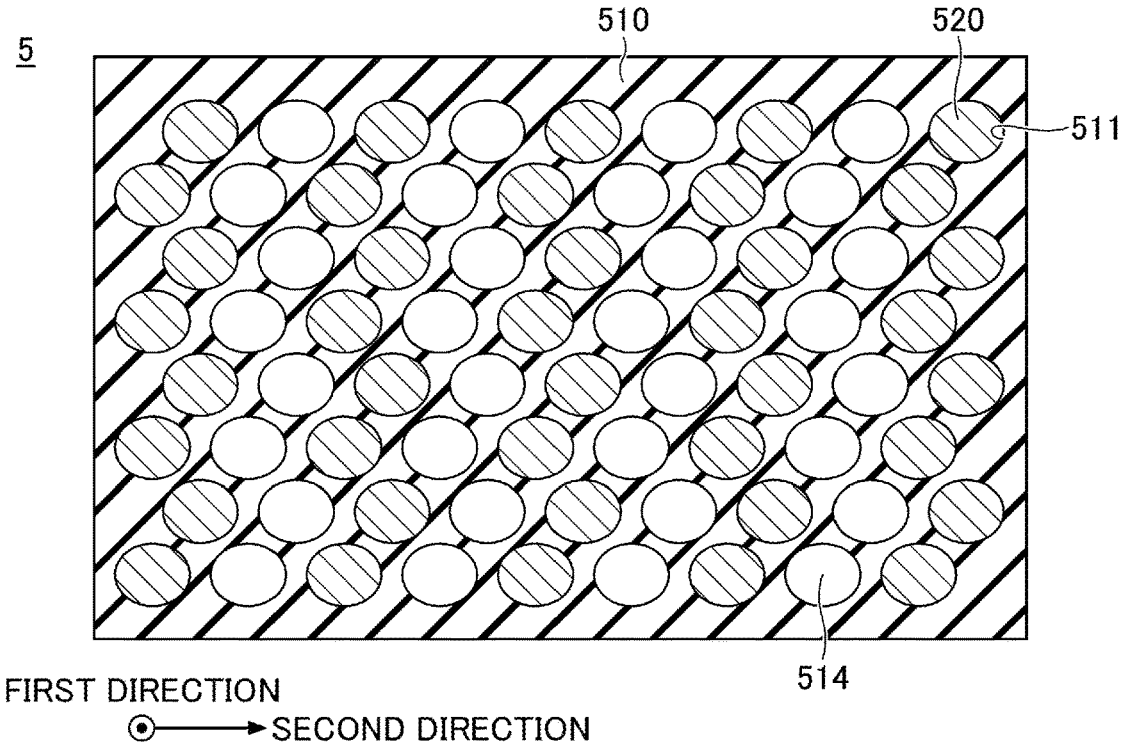
FIG. 9A and FIG. 9B are cross sectional views illustrating examples of an arrangement of through holes and metal parts in the fifth embodiment.
Figure 9B:
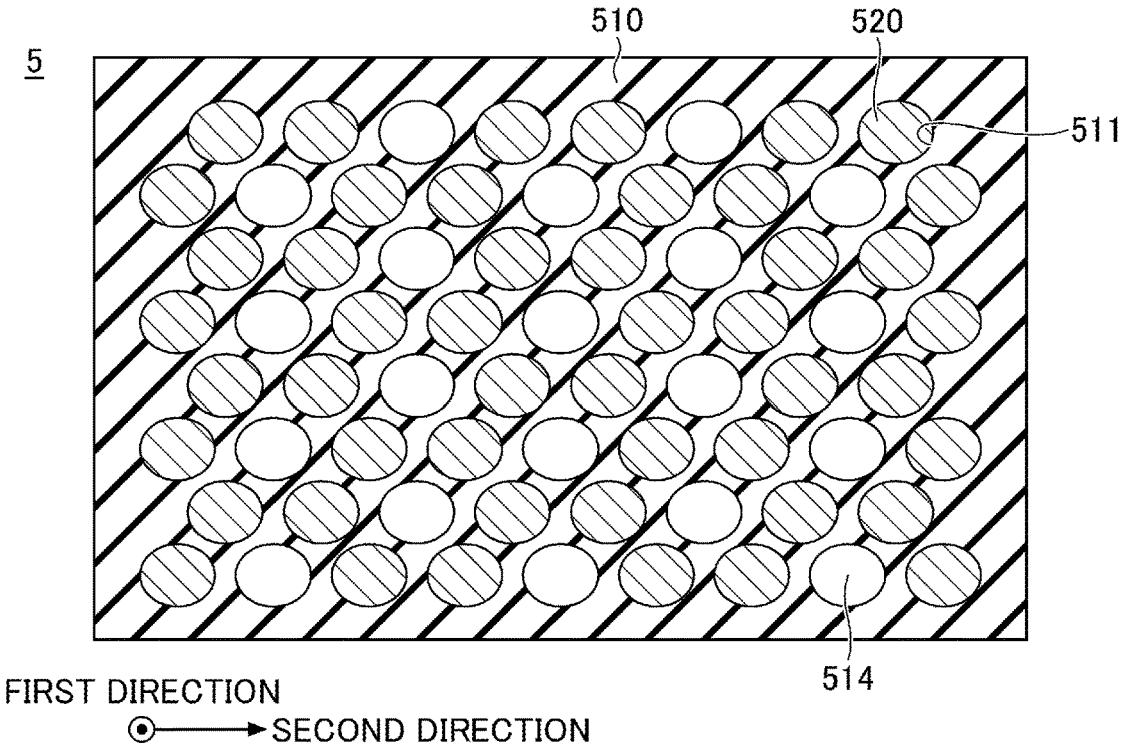

Next, an example of an arrangement of the through holes 514 and the metal parts 520 will be described. FIG. 9A and FIG. 9B are cross sectional views illustrating examples of the arrangement of the through holes 514 and the metal parts 520 in the fifth embodiment.

In the example illustrated in FIG. 9A, the through holes 514 and the metal parts 520 are alternately arranged along a second direction perpendicular to the first direction. When viewed from the first direction, the through holes 514 and the metal parts 520 form triangular lattices. For example, two through holes 514 and one metal part 520 may form a triangular lattice, or one through hole 514 and two metal parts 520 may form a triangular lattice.

In the example illustrated in FIG. 9B, the through holes 514 and pairs of the metal parts 520 are alternately arranged along the second direction perpendicular to the first direction. When viewed from the first direction, the through holes 514 and the metal parts 520 form triangular lattices. For example, one through hole 514 and the pair of metal parts 520 form a triangular lattice. Each of the through holes 514 is surrounded by six metal parts 520.

Sixth Embodiment

Figure 10A:
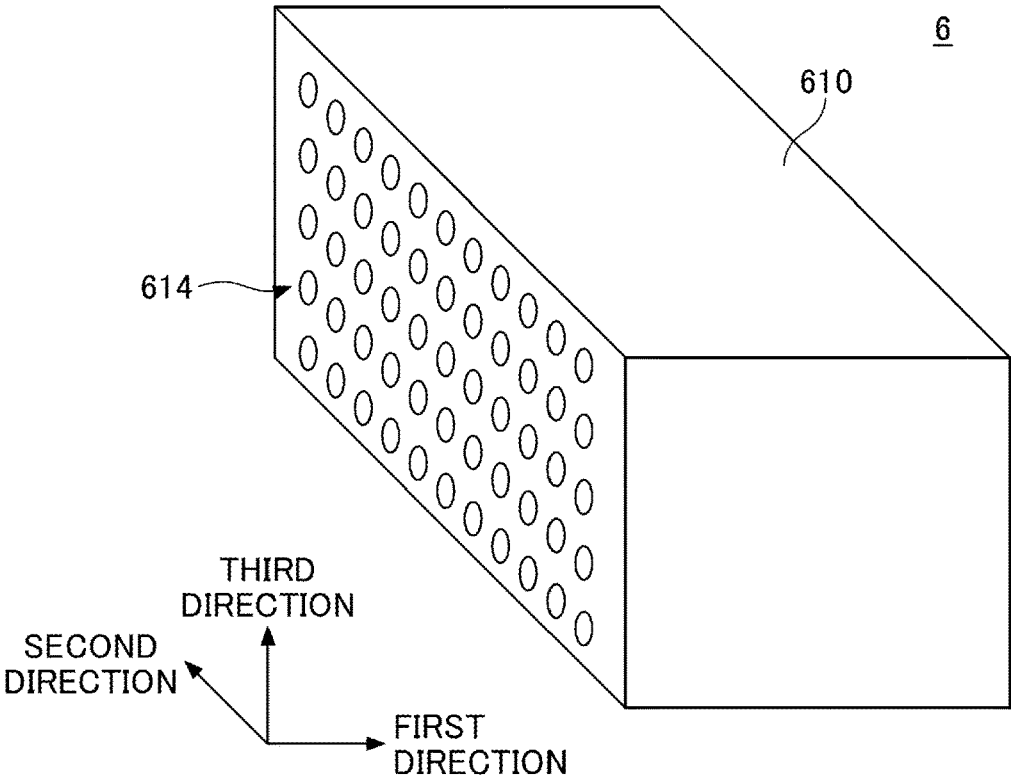
FIG. 10A and FIG. 10B are diagrams illustrating an example of the latent heat storage according to a sixth embodiment.
Figure 10B:
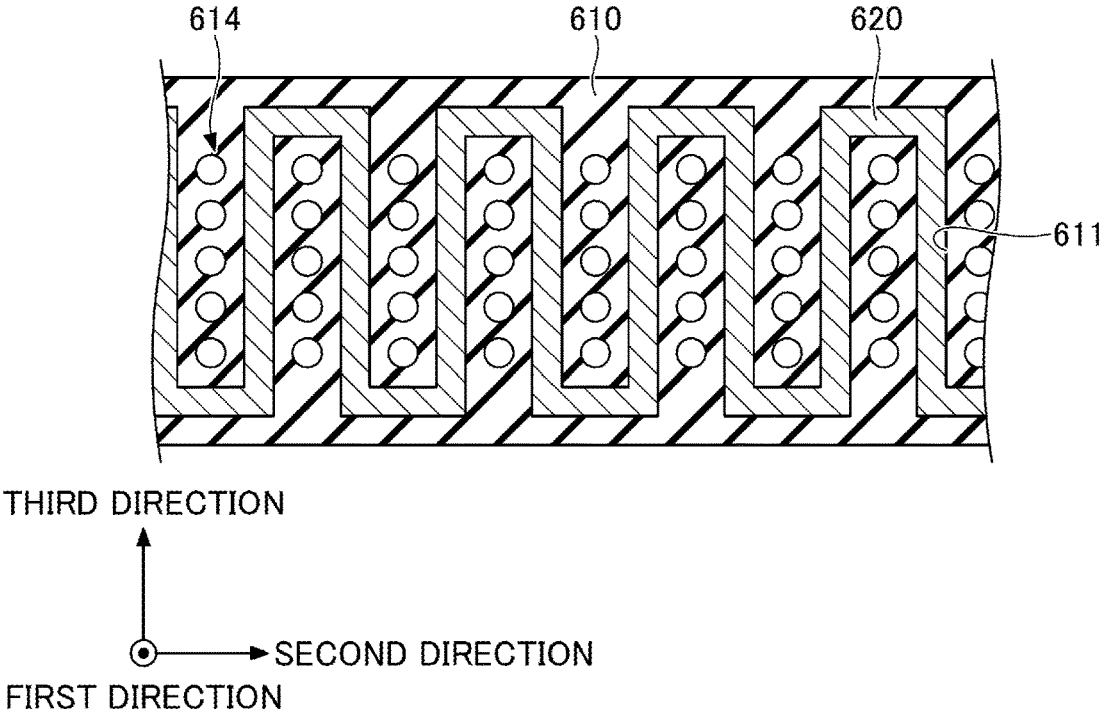
Figure 11:
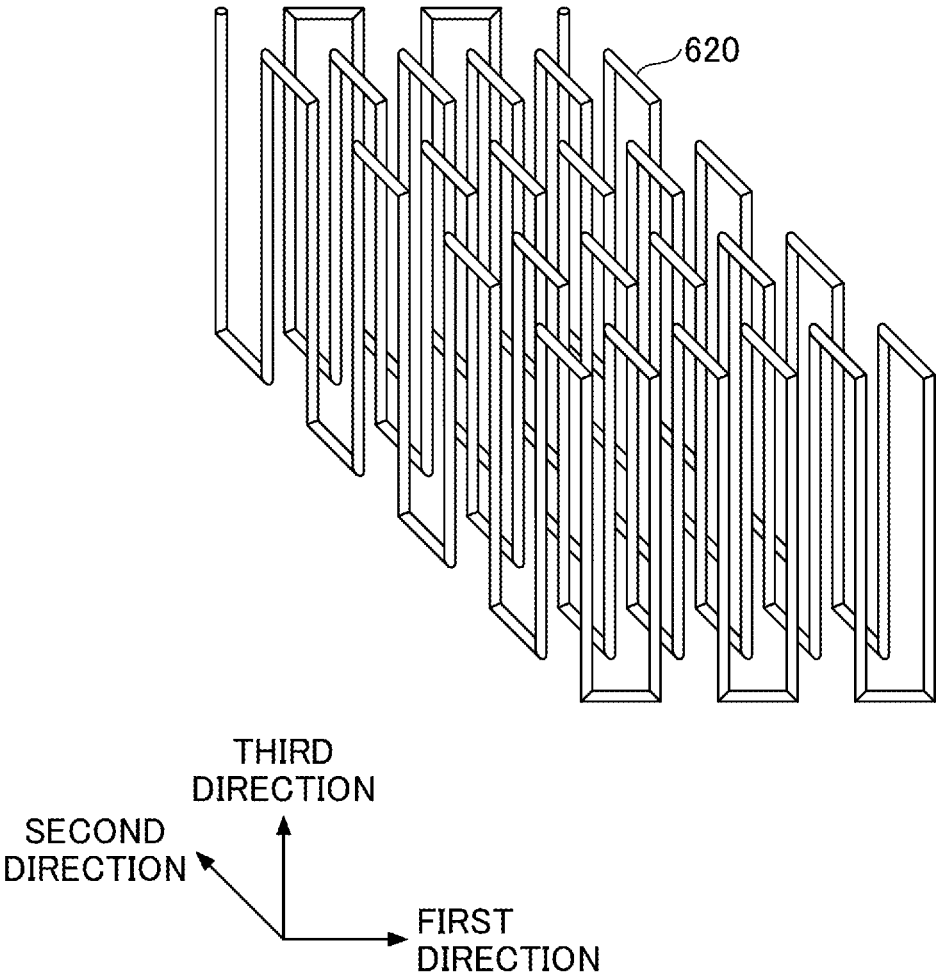
FIG. 11 is a perspective view illustrating the metal parts included in the latent heat storage according to the sixth embodiment.

A sixth embodiment described hereunder relates to a latent heat storage. FIG. 10A and FIG. 10B are diagrams illustrating an example of the latent heat storage according to the sixth embodiment. FIG. 10A is a perspective view of the latent heat storage, and FIG. 10B is a cross sectional view of the latent heat storage. FIG. 11 is a perspective view illustrating a metal part included in the latent heat storage according to the sixth embodiment.

As illustrated in FIG. 10A, FIG. 10B, and FIG. 11, the latent heat storage 6 according to the sixth embodiment includes a ceramic part 610 formed of a polycrystalline material, and a metal part 620.

A plurality of closed spaces 611 is formed inside the ceramic part 610. The ceramic part 610 has an approximately rectangular parallelepiped shape. A plurality of through holes 614, extending in the first direction, is formed in the ceramic part 610. The first direction is perpendicular to a pair of parallel surfaces of the ceramic part 610. The through holes 614 are arranged at equal intervals in two mutually perpendicular directions that are perpendicular to the first direction, namely, the second direction perpendicular to the first direction, and a third direction perpendicular to the first direction. The closed space 611 has a bellows shape extending in the second direction. The closed space 611 is famed so as to weave through the regularly arranged through holes 614. The closed space 611 includes portions extending in the second direction and portions extending in the third direction, and the portions extending in the second direction and the portions extending in the third direction are alternately connected to one another. The plurality of closed spaces 611 is formed side by side along the first direction. The closed spaces 611 adjacent to each other in the first direction may be connected to each other. The ceramic part 610 is integrally formed, for example. For example, the ceramic part 610 does not have a bonding portion in the closed space 611, bonding two ceramic pieces with opposing cavities, for example. The ceramic part 610 is famed of a material similar to the material used for the ceramic part 110.

The metal part 620 is provided inside the closed space 611. In other words, the metal part 620 is sealed by the ceramic part 610. That is, the metal part 620 is covered airtight with the ceramic part 610 that is a continuous body. The metal part 620 has a bellows shape extending in the second direction. The metal part 620 is provided so as to weave through the regularly arranged through holes 614. The metal part 620 includes portions extending in the second direction and portions extending in the third direction, and the portions extending in the second direction and the portions extending in the third direction are alternately connected to one another. A plurality of metal parts 620 is provided side by side along the first direction. The metal parts 620 adjacent to each other in the first direction may be connected to each other.

A volume of the closed space 611 is preferably larger than a volume of the metal part 620. In a case where the volume of the closed space 611 is larger than the volume of the metal part 620, a gap is formed between an outer surface of the metal part 620 and an inner surface of the closed space 611, although the illustration of this gap is omitted in FIG. 10B. The gap between the surface of the metal part 620 and the inner surface of the closed space 611 may be present at only one location, or may be present at a plurality of locations.

Otherwise, the configuration of the sixth embodiment is similar to that of the first embodiment. In addition, the latent heat storage 6 according to the sixth embodiment can be manufactured by a method similar to that used for the first embodiment, except for the shape of the latent heat storage 6 that is different from the shape of the latent heat storage 1.

According to the sixth embodiment, it is possible to obtain effects similar to those obtainable by the first embodiment. In addition, the plurality of through holes 614 can be used as a flow path of the heating medium. In this case, it is easy to stabilize the flow rate and the flow velocity of the heating medium.

Seventh Embodiment

Figure 12A:
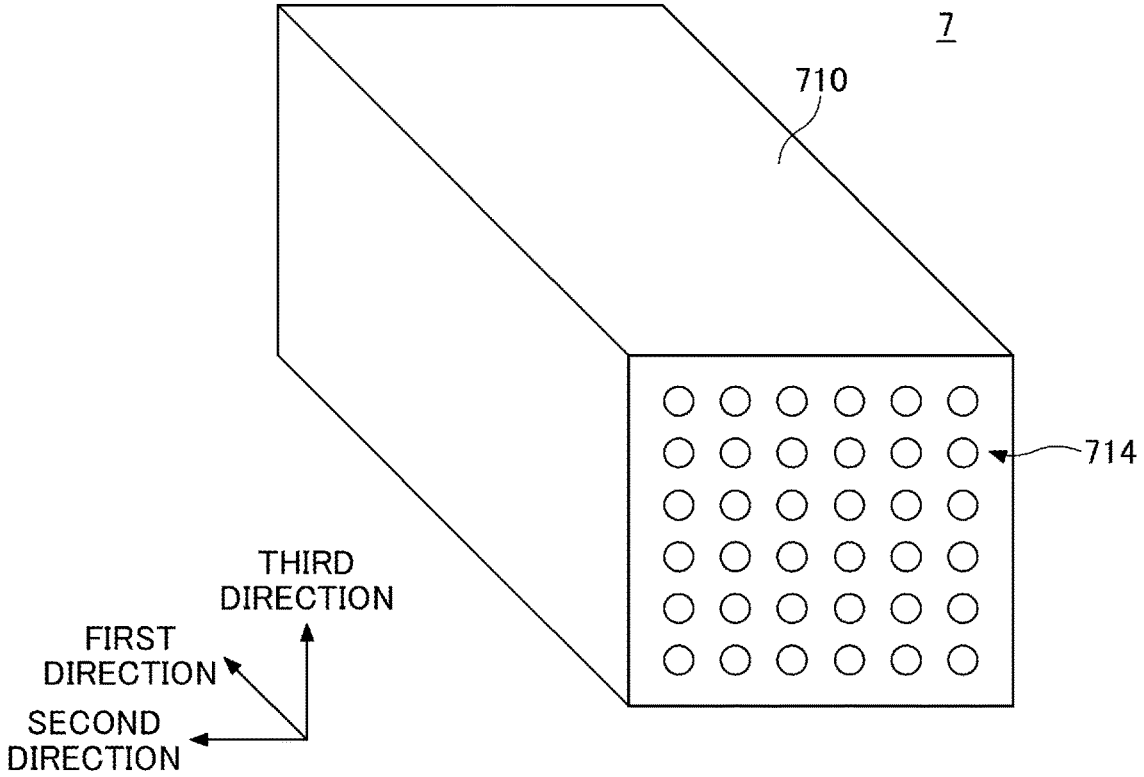
FIG. 12A and FIG. 12B are diagrams illustrating an example of the latent heat storage according to a seventh embodiment.
Figure 12B:
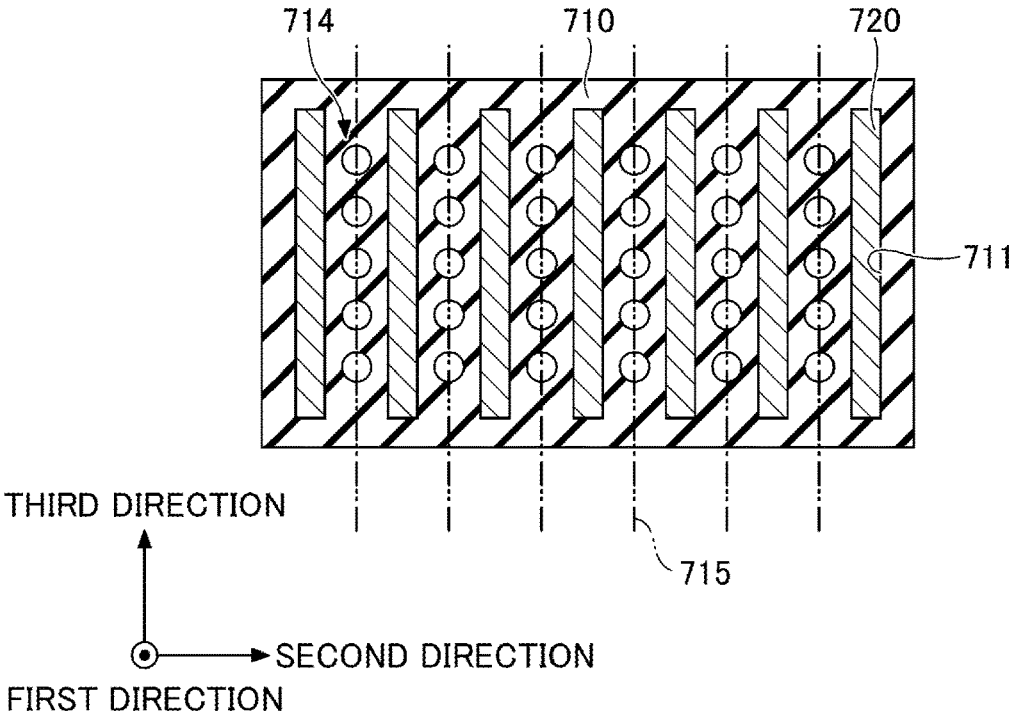
Figure 13:
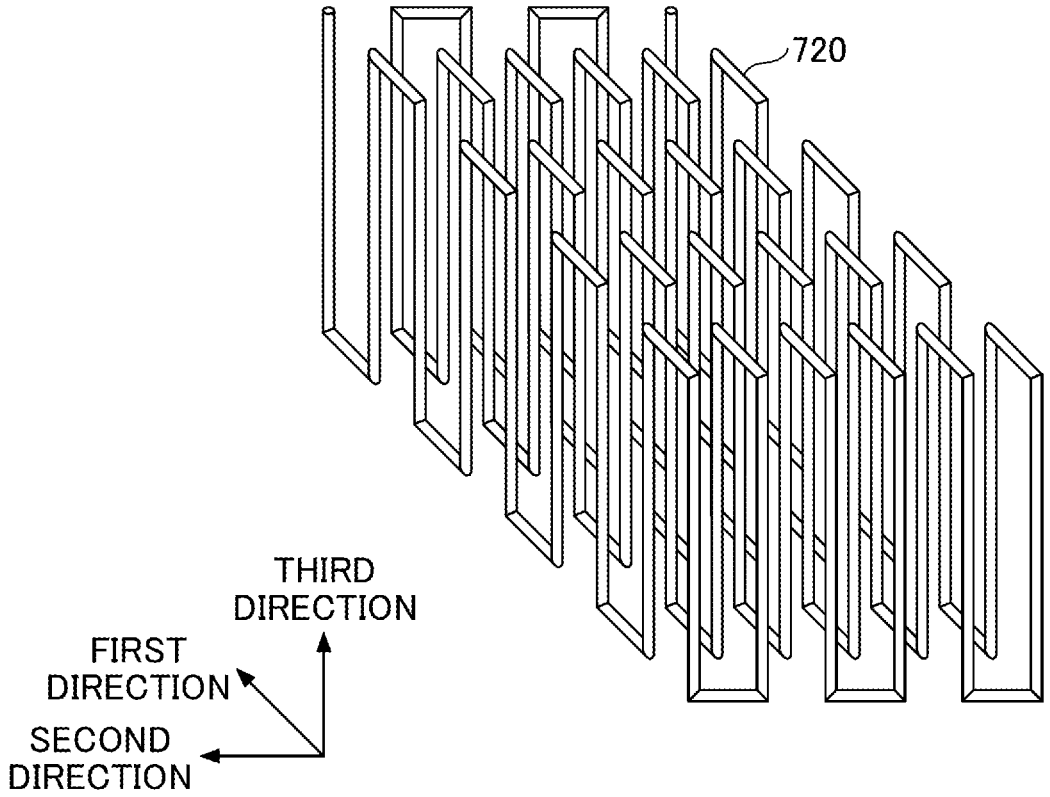
FIG. 13 is a perspective view illustrating the metal part included in the latent heat storage according to the seventh embodiment.

A seventh embodiment described hereunder relates to a latent heat storage. FIG. 12A and FIG. 12B are diagrams illustrating an example of the latent heat storage according to the seventh embodiment. FIG. 12A is a perspective view of the latent heat storage, and FIG. 12B is a cross sectional view of the latent heat storage. FIG. 13 is a perspective view illustrating a metal part included in the latent heat storage according to the seventh embodiment.

As illustrated in FIG. 12A, FIG. 12B, and FIG. 13, a latent heat storage 7 according to the seventh embodiment includes a ceramic part 710 formed of a polycrystalline material, and a metal part 720.

A plurality of closed spaces 711 is formed inside the ceramic part 710. The ceramic part 710 has an approximately rectangular parallelepiped shape. A plurality of through holes 714, extending in the first direction, is formed in the ceramic part 710. The first direction is perpendicular to a pair of parallel surfaces of the ceramic part 710. The through holes 714 are arranged at equal intervals in two mutually perpendicular directions that are perpendicular to the first direction, namely, the second direction perpendicular to the first direction, and the third direction perpendicular to the first direction. The closed space 711 has a bellows shape extending in the first direction. When it is assumed that the plurality of through holes 714 adjacent in the third direction is aligned to each of a plurality of virtual planes 715, the closed space 711 is formed between the virtual planes 715 adjacent to each other in the second direction. The closed space 711 includes portions extending in the first direction and portions extending in the third direction, and the portions extending in the first direction and the portions extending in the third direction are alternately connected to one another. The plurality of closed spaces 711 is formed side by side along the second direction. The closed spaces 711 adjacent to each other in the second direction may be connected to each other. The ceramic part 710 is integrally formed, for example. For example, the ceramic part 710 does not have a bonding portion in the closed space 711, bonding two ceramic pieces with opposing cavities, for example. The ceramic part 710 is formed of a material similar to the material used for the ceramic part 110.

The metal part 720 is provided inside the closed space 711. In other words, the metal part 720 is sealed by the ceramic part 710. That is, the metal part 720 is covered airtight with the ceramic part 710 that is a continuous body. The metal part 720 has a bellows shape extending in the first direction. The metal part 720 is provided between the virtual planes 715 adjacent to each other in the second direction. The metal part 720 includes portions extending in the first direction and portions extending in the third direction, and the portions extending in the first direction and the portions extending in the third direction are alternately connected to one another. A plurality of metal parts 720 is provided side by side along the second direction. The metal parts 720 adjacent to each other in the second direction may be connected to each other.

A volume of the closed space 711 is preferably larger than a volume of the metal part 720. In a case where the volume of the closed space 711 is larger than the volume of the metal part 720, a gap is formed between an outer surface of the metal part 720 and an inner surface of the closed space 711, although the illustration of this gap is omitted in FIG. 12B. The gap between the outer surface of the metal part 720 and the inner surface of the closed space 711 may be present at only one location, or may be present at a plurality of locations.

Otherwise, the configuration of the seventh embodiment may be similar to that of the first embodiment. In addition, the latent heat storage 7 according to the seventh embodiment can be manufactured by a method similar to that used for the first embodiment, except for the shape of the latent heat storage 7 that is different from the shape of the latent heat storage 1.

According to the seventh embodiment, it is possible to obtain effects similar to those obtainable by the first embodiment. In addition, the plurality of through holes 714 can be used as a flow path of the heating medium. In this case, it is easy to stabilize the flow rate and the flow velocity of the heating medium.

Eighth Embodiment

Figure 14:
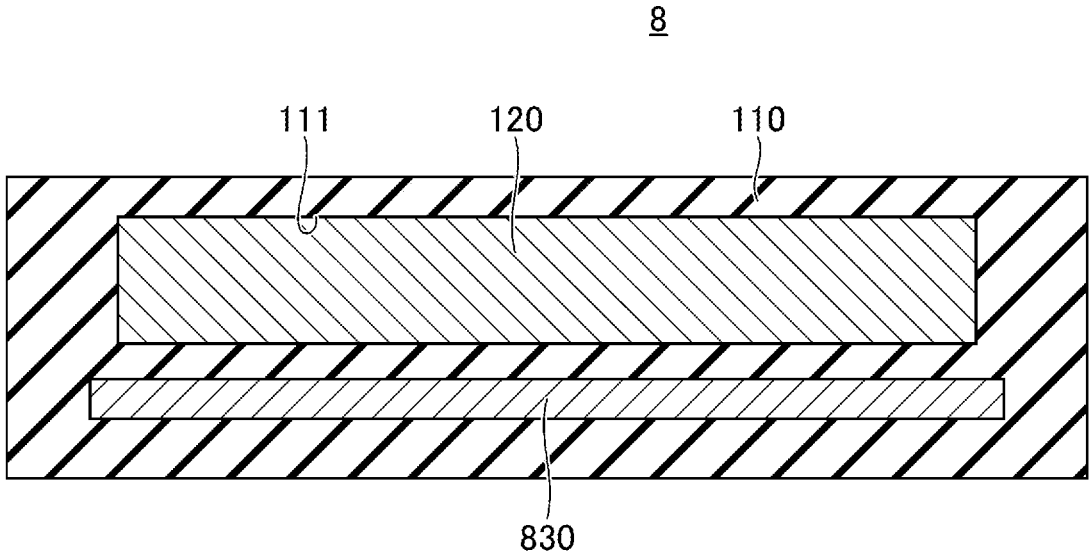
FIG. 14 is a cross sectional view illustrating an example of the latent heat storage according to an eighth embodiment.

An eighth embodiment described hereunder relates to a latent heat storage. FIG. 14 is a cross sectional view illustrating an example of the latent heat storage according to the eighth embodiment.

As illustrated in FIG. 14, the latent heat storage 8 according to the eighth embodiment includes a ceramic part 110 formed of a polycrystalline material, a metal part 120, and a heater element 830 capable of heating the metal part 120, that is, configured to heat the metal part 120.

The heater element 830 is provided inside the ceramic part 110. The heater element 830 is provided near one of a pair of largest surfaces of the metal part 120, for example. The heater element 830 includes a mixture of tungsten and aluminum oxide, or a mixture of molybdenum and aluminum oxide, for example. In this case, the heater element 830 may further include one or more kinds of elements selected from silicon oxide, magnesium oxide, calcium carbonate, or the like. The heater element 830 is an example of a heater.

Otherwise, the configuration of the eighth embodiment may be similar to that of the first embodiment.

When manufacturing the latent heat storage 8 according to the eighth embodiment, an aluminum oxide powder is mixed with a tungsten or molybdenum powder, and an organic component, such as a solvent, a binder, or the like, is added to prepare a paste. A paste part for the heater element, having the shape of the heater element 830, is famed by screen printing or the like, for example. The paste part for the heater element is fired in a neutral atmosphere or a reducing atmosphere, simultaneously as the ceramic part 130 and the metal part 140. A resistivity of the heater element 830 can be adjusted according to an amount of the aluminum oxide. Further, one or more kinds of elements selected from silicon oxide, magnesium oxide, calcium carbonate, or the like, may further be added to the paste. These inorganic components form a liquid phase or a complex oxide phase during the firing, and can improve an adhesion strength between the heater element 830 and the ceramic part 130, and improve a stability of the resistivity.

According to the eighth embodiment, it is possible to obtain effects similar to those obtainable by the first embodiment. Further, because the heater element 830 can heat the metal part 120, an electrical energy applied from the outside can be converted into heat and stored in the latent heat storage 8. For example, by generating heat from the heater element 830 by surplus power, the surplus power can be stored as heat. The energy stored in the latent heat storage 8 can be supplied to a factory, an office, a commercial building, or the like, as energy of heat, steam (pressure), or electric power (turbine power generation by steam pressure, or the like).

In addition, because the latent heat storage 8 includes the heater element 830, an energy loss can be reduced. For example, in a case where the heater element and the latent heat storage are separated from each other, the heat generated from the heater element is transferred to the latent heat storage as hot air or the like, thereby easily causing an energy loss. However, in the present embodiment, such an energy loss can be reduced.

The resistivity of the heater element 830 can be adjusted not only by adjusting the aluminum oxide content, but also by adjusting a cross sectional area and a length of the heater element 830.

[First Modification of Eighth Embodiment]

Figure 15:
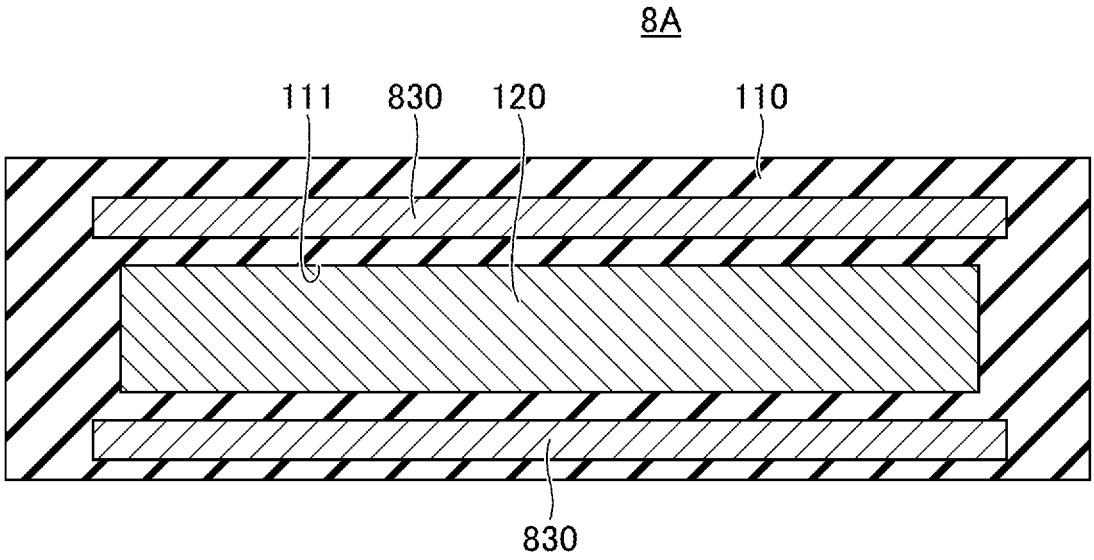
FIG. 15 is a cross sectional view illustrating an example of the latent heat storage according to a first modification of the eighth embodiment.

A first modification of the eighth embodiment will be described. FIG. 15 is a cross sectional view illustrating an example of the latent heat storage according to the first modification of the eighth embodiment.

As illustrated in FIG. 15, a latent heat storage 8A according to the first modification of the eighth embodiment includes a ceramic part 110 formed of a polycrystalline material, a metal part 120, and two heater elements 830 capable of heating the metal part 120. One heater element 830 is provided near one of the pair of largest surfaces of the metal part 120, and the other heater element 830 is provided near the other of the pair of largest surfaces of the metal part 120.

Otherwise, the configuration of the first modification of the eighth embodiment is similar to that of the eighth embodiment.

According to the first modification of the eighth embodiment, it is possible to obtain effects similar to those obtainable by the eighth embodiment. In addition, according to the first modification of the eighth embodiment, the metal part 120 can be heated more easily.

[Second Modification of Eighth Embodiment]

Figure 16:
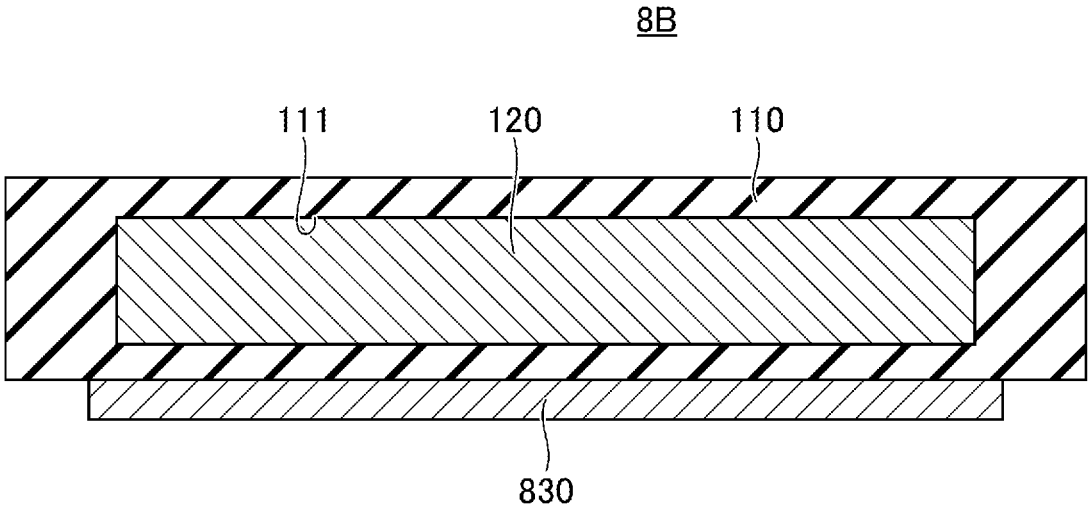
FIG. 16 is a cross sectional view illustrating an example of the latent heat storage according to a second modification of the eighth embodiment.

A second modification of the eighth embodiment will be described. FIG. 16 is a cross sectional view illustrating an example of the latent heat storage according to the second modification of the eighth embodiment.

As illustrated in FIG. 16, a latent heat storage 8B according to the second modification of the eighth embodiment has the heater element 830 provided on the surface of the ceramic part 110. The heater element 830 is provided near one of the pair of largest surfaces of the metal part 120, for example. The heater element 830 includes molybdenum disilicide, ruthenium oxide, a nickel-chromium alloy, or a silver-palladium alloy, for example. In this case, the heater element 830 may further include glass.

Otherwise, the configuration of the second modification of the eighth embodiment is similar to that of the first embodiment.

When manufacturing the latent heat storage 8B according to the second modification of the eighth embodiment, after the ceramic part 130 and the metal part 140 are fired simultaneously by co-firing, an organic component, such as a solvent, a binder, or the like, is added to molybdenum disilicide, ruthenium oxide, a nickel-chromium alloy, or a silver-palladium alloy, to prepare a paste. A paste part for the heater element, having the shape of the heater element 830, is formed by screen printing or the like, for example. The paste part for the heater element may be fired in an oxidizable atmosphere, such as an air atmosphere or the like. Glass may be added to the paste part for the heater element. Platinum may be used as the material for the heater element 830, and a material similar to the material used in the eighth embodiment may also be used.

Two heater elements 830 may be provided on two surfaces of the ceramic part 110. For example, one heater element 830 may be provided near one of the pair of largest surfaces of the metal part 120, and the other heater element 830 may be provided near the other of the pair of largest surfaces of the metal part 120.

Ninth Embodiment

Figure 17A:
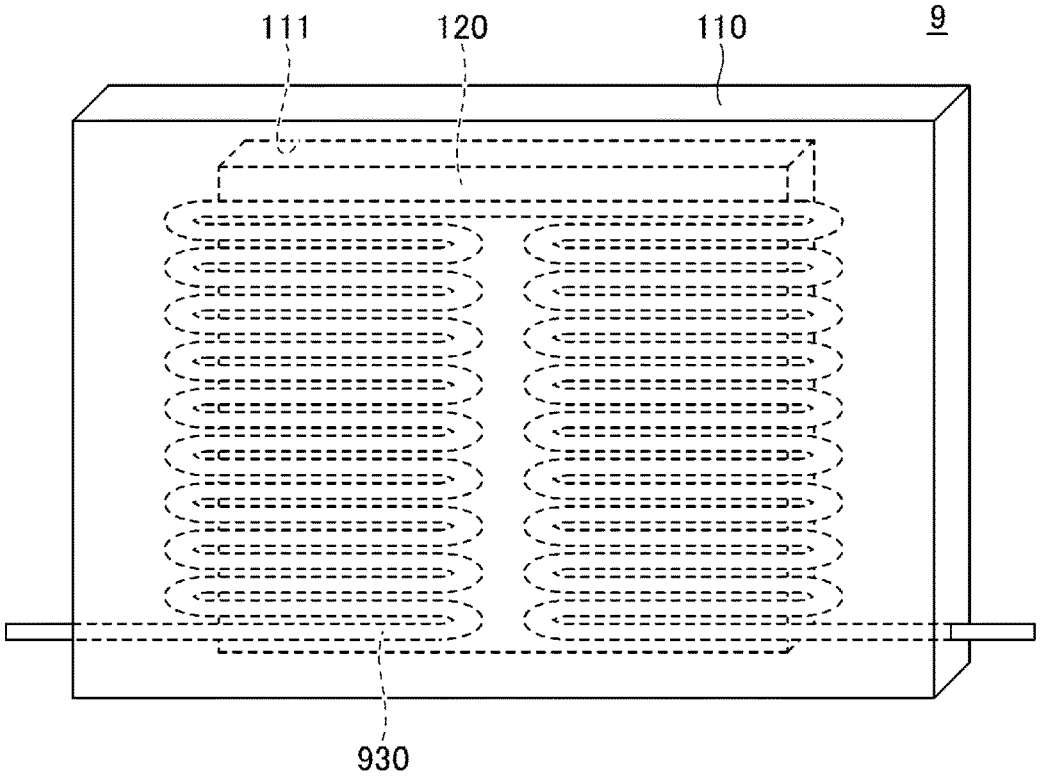
FIG. 17A and FIG. 17B are diagrams illustrating an example of the latent heat storage according to a ninth embodiment.
Figure 17B:
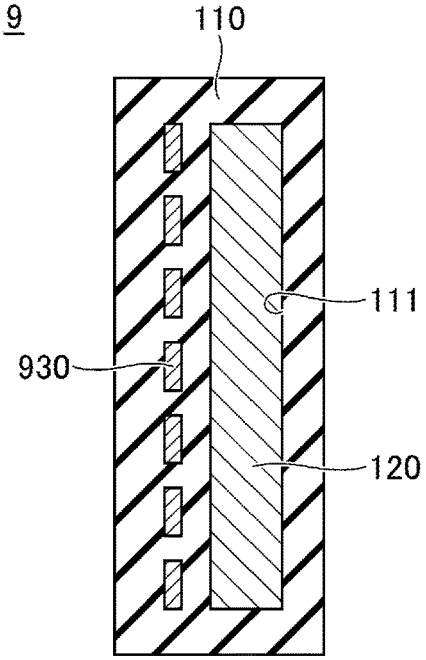

A ninth embodiment described hereunder relates to a latent heat storage. FIG. 17A and FIG. 17B are diagrams illustrating an example of the latent heat storage according to the ninth embodiment. FIG. 17A is a perspective view of the latent heat storage, and FIG. 17B is a cross sectional view of the latent heat storage.

As illustrated in FIG. 17A and FIG. 17B, a latent heat storage 9 according to the ninth embodiment includes a ceramic part 110 formed of a polycrystalline material, a metal part 120, and a heater element 930 capable of heating the metal part 120.

The heater element 930 is provided inside the ceramic part 110. The heater element 930 is provided near one of the pair of largest surfaces of the metal part 120, for example. The heater element 930 is arranged in a bellows shape. The heater element 930 is formed of a material similar to the material used for the heater element 830. The heater element 930 is an example of a heater.

Otherwise, the configuration of the ninth embodiment is similar to that of the eighth embodiment. The latent heat storage 9 according to the ninth embodiment can be manufactured by a method similar to that for the eighth embodiment, except for the shape of the latent heat storage 9 that is different from the shape of the latent heat storage 8.

According to the ninth embodiment, it is possible to obtain effects similar to those obtainable by the eighth embodiment. In addition, because the heater element 930 is arranged in the bellows shape, a larger heat value can be obtained, that is, a larger amount of heat can be generated.

Figure 18A:
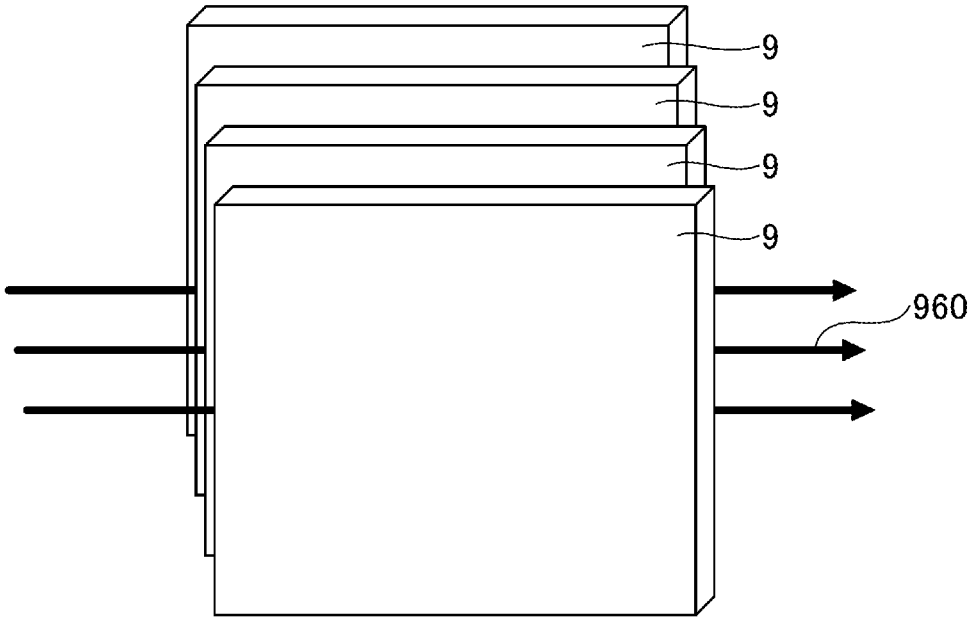
FIG. 18A and FIG. 18B are diagrams illustrating an example of a method for using the latent heat storage according to the ninth embodiment.
Figure 18B:
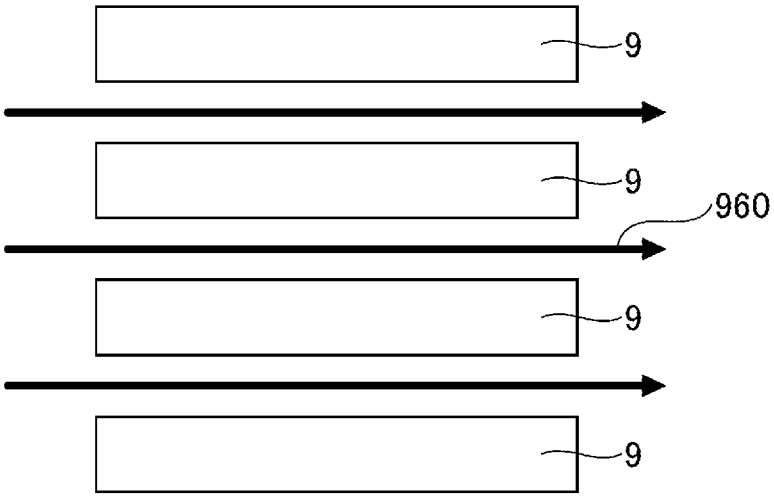

Next, an example of a method for using the latent heat storage 9 according to the ninth embodiment will be described. FIG. 18A and FIG. 18B are diagrams illustrating an example of the method for using the latent heat storage 9 according to the ninth embodiment. FIG. 18A is a perspective view of the latent heat storage, and FIG. 18B is a top view of the latent heat storage.

In this example, as illustrated in FIG. 18A and FIG. 18B, a plurality of latent heat storages 9 having the same shape is used. The plurality of latent heat storages 9 is arranged in a row, and the largest surfaces of the adjacent latent heat storages 9 oppose each other.

At the time of storing heat, heat is generated from the heater element 930 to melt the metal part 120. When using the heat stored in the latent heat storages 9, a heating medium 960 having a temperature lower than the melting point of the metal part 120 is supplied toward the latent heat storages 9, as illustrated in FIG. 18A and FIG. 18B. The heating medium 960 is heated by the latent heat storages 9, and moves away from the latent heat storages 9 in a state having a larger thermal energy than that at the time when the heating medium 960 was supplied toward the latent heat storages 9. Hence, the thermal energy can be transferred to the heating medium 960.

Tenth Embodiment

Figure 19:
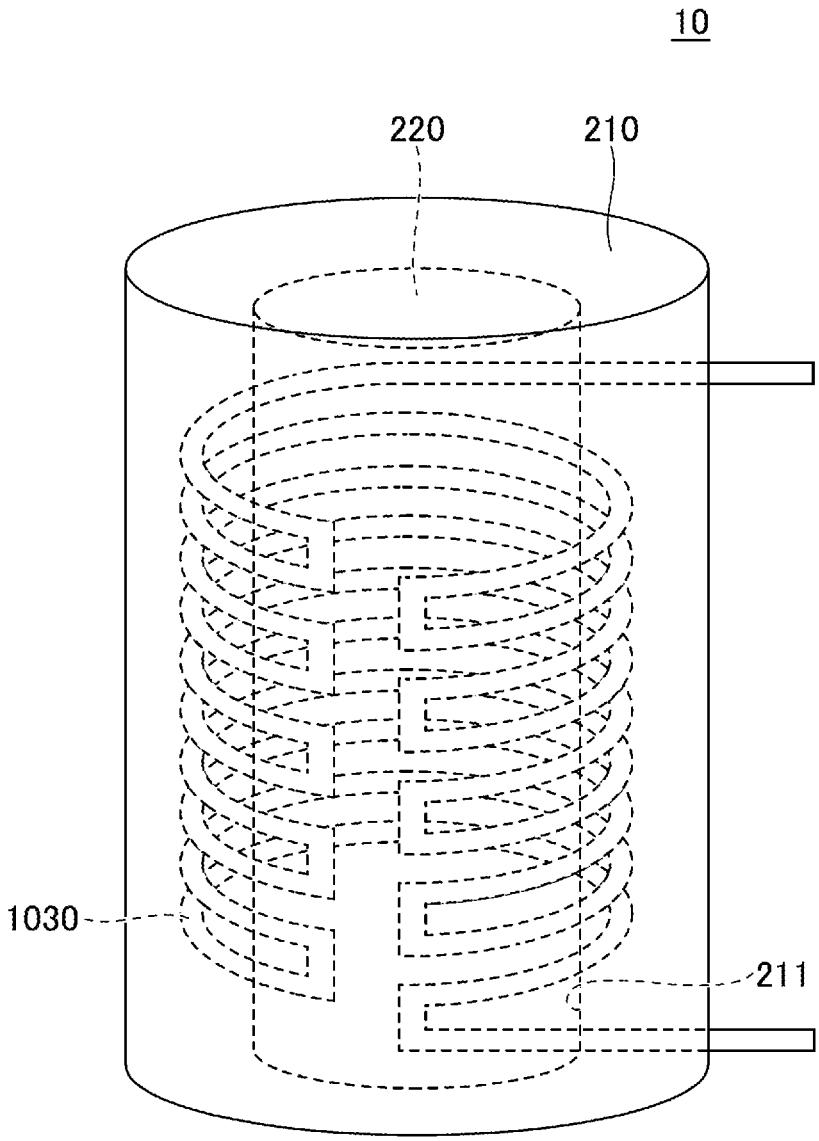
FIG. 19 is a perspective view illustrating an example of the latent heat storage according to a tenth embodiment.

A tenth embodiment described hereunder relates to a latent heat storage. FIG. 19 is a perspective view illustrating an example of the latent heat storage according to the tenth embodiment.

As illustrated in FIG. 19, a latent heat storage according to the tenth embodiment includes a ceramic part 210 formed of a polycrystalline material, a metal part 220, and a heater element 1030 capable of heating the metal part 220. The heater element 1030 is provided between an inner surface of the ceramic part 210 and an outer surface of the metal part 220. The heater element 1030 has an approximately cylindrical shape. When viewed from a direction parallel to a longitudinal axis of the columnar metal part 220, the heater element 1030 forms a spiral while alternately repeating a clockwise turn and a counterclockwise turn, for example. The heater element 1030 is famed of a material similar to the material used for the heater element 830. The heater element 1030 is an example of a heater.

Otherwise, the configuration of the tenth embodiment is similar to that of the eighth embodiment. The latent heat storage 10 according to the tenth embodiment can be manufactured by a method similar to method for the eighth embodiment, except for the shape of the latent heat storage 10 that is different from the shape of the latent heat storage 8. A portion (circumferential portion) of the heater element 1030 perpendicular to the longitudinal axis of the metal part 220 can be formed by a resistor paste printed on a surface of a ceramic green sheet, for example. The portion of the heater element 1030 extending parallel to the longitudinal axis of the metal part 220 can also be formed by a resistor paste filling a through hole formed in a ceramic green sheet, for example.

According to the ninth embodiment, it is possible to obtain effects similar to those obtainable by the eighth embodiment. In addition, because the heater element 1030 is formed in a spiral shape, a larger amount of heat can be generated.

The ceramic part 210 and the metal part 220 may have a prismatic shape, and the heater element 1030 may have an approximately prismatic tubular shape.

Figure 20:
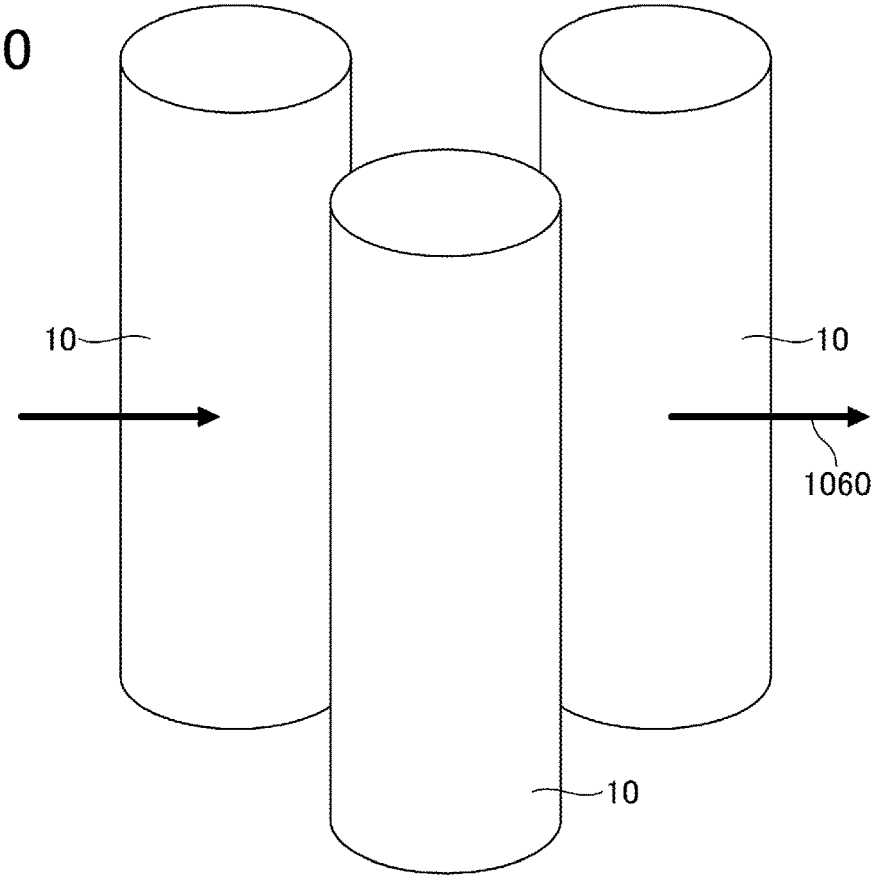
FIG. 20 is a diagram illustrating an example of the method for using the latent heat storage according to the tenth embodiment.

Next, an example of a method for using the latent heat storage 10 according to the tenth embodiment will be described. FIG. 20 is a view illustrating an example of the method for using the latent heat storage according to the tenth embodiment.

In this example, as illustrated in FIG. 20, a plurality of latent heat storages 10 having the same shape is used. The plurality of latent heat storages 10 is arranged on a plane parallel to a bottom surface of the ceramic part 210.

At the time of storing heat, heat is generated from the heater element 1030 to melt the metal part 120. When using the heat stored in the latent heat storages 10, a heating medium 1060 having a temperature lower than the melting point of the metal part 120 is supplied toward the latent heat storages 10. The heating medium 1060 is supplied in a direction parallel to the bottom surface of the ceramic part 210, for example. The heating medium 1060 is heated by the latent heat storages 10, and moves away from the latent heat storages 10 in a state having a larger thermal energy than that at the time when the heating medium 1060 was supplied toward the latent heat storages 10. Hence, the thermal energy can be transferred to the heating medium 1060.

The heating medium 1060 may be supplied in a direction perpendicular to the bottom surface of the ceramic part 210.

Eleventh Embodiment

Figure 21:
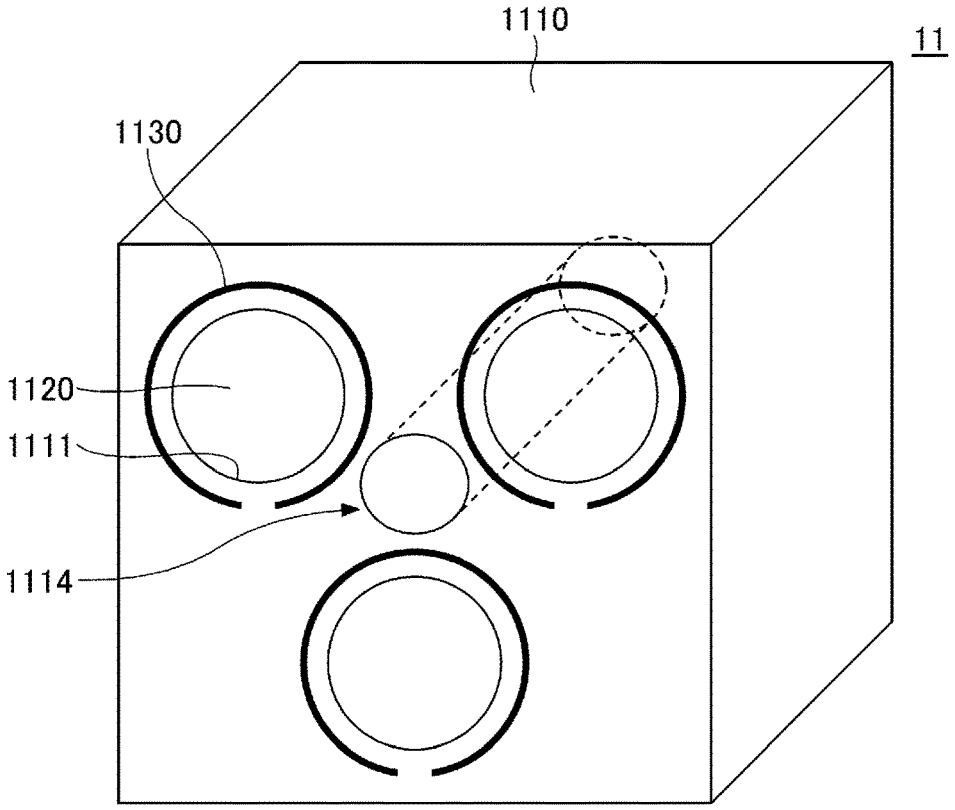
FIG. 21 is a perspective cross sectional view illustrating an example of the latent heat storage according to an eleventh embodiment.

An eleventh embodiment described hereunder relates to a latent heat storage. FIG. 21 is a perspective cross sectional view illustrating an example of the latent heat storage according to the eleventh embodiment.

As illustrated in FIG. 21, a latent heat storage 11 according to the eleventh embodiment includes a ceramic part 1110 formed of a polycrystalline material, a plurality of metal parts 1120, and a plurality of heater elements 1130 capable of heating the metal parts 1120.

A plurality of closed spaces 1111 is formed inside the ceramic part 1110. The plurality of closed spaces 1111 has a cylindrical shape. The plurality of closed spaces 1111 extends in the same direction. A through hole 1114, extending parallel to the plurality of closed spaces 1111, is formed in the ceramic part 1110. The plurality of closed spaces 1111 is provided near the through hole 1114. The ceramic part 1110 is integrally formed, for example. For example, the ceramic part 1110 does not have a bonding portion in the closed space 1111, bonding two ceramic pieces with opposing cavities, for example. The ceramic part 1110 is formed of a material similar to the material used for the ceramic part 110.

One metal part 1120 is provided in each of the plurality of closed spaces 1111. In other words, the metal parts 1120 are sealed by the ceramic part 1110. That is, the metal parts 1120 are covered airtight with the ceramic part 1110 that is a continuous body. The metal parts 120 have a columnar shape. The metal parts 1120 are formed of a material similar to the material used for the metal part 120.

A volume of the closed space 1111 is preferably larger than a volume of the metal part 1120. In a case where the volume of the closed space 1111 is larger than the volume of the metal part 1120, a gap is formed between an outer surface of the metal part 1120 and an inner surface of the closed space 1111, although the illustration of this gap is omitted in FIG. 21. The gap between the outer surface of the metal part 1120 and the inner surface of the closed space 1111 may be present at only one location, or may be present at a plurality of locations.

The heater element 1130 is provided inside the ceramic part 1110. For example, similar to the heater element 1030, the heater element 1130 has an approximately cylindrical shape, and when viewed from a direction parallel to the longitudinal axis of the columnar metal part 1120, for example, the heater element 1130 forms a spiral while alternately repeating a clockwise turn and a counterclockwise turn. The heater element 1130 is famed of a material similar to the material used for the heater element 830. The heater element 1130 is an example of a heater.

The latent heat storage 11 according to the eleventh embodiment can be manufactured by a method similar to that for the tenth embodiment, except for the shape of the latent heat storage 11 that is different from the shape of the latent heat storage 10.

At the time of storing heat, heat is generated from the heater element 1130 to melt the metal part 1120. When using the heat stored in the latent heat storage 11, a heating medium having a temperature lower than the melting point of the metal part 1120 is supplied into the through hole 1114. The heating medium is heated by the latent heat storage 11, and moves away from the latent heat storage 11 in a state having a larger thermal energy than that at the time when the heating medium was supplied toward the latent heat storage 11. Hence, the thermal energy can be transferred to the heating medium.

According to the eleventh embodiment, it is possible to obtain effects similar to those obtainable by the tenth embodiment.

Twelfth Embodiment

Figure 22:
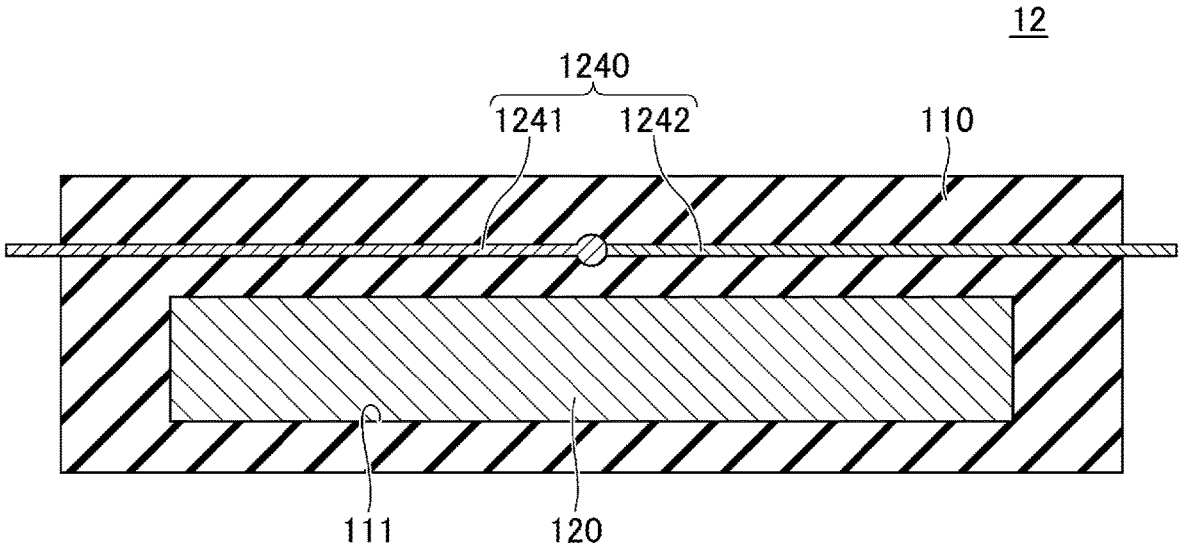
FIG. 22 is a cross sectional view illustrating an example of the latent heat storage according to a twelfth embodiment.

A twelfth embodiment described hereunder relates to a latent heat storage. FIG. 22 is a cross sectional view illustrating an example of the latent heat storage according to the twelfth embodiment.

As illustrated in FIG. 22, a latent heat storage 12 according to the twelfth embodiment includes a ceramic part 110 formed of a polycrystalline material, a metal part 120, and a thermocouple 1240 that generates an electromotive force (or electric power) by a temperature change in the metal part 120.

The thermocouple 1240 includes a first conductor 1241, and a second conductor 1242. One end of the first conductor 1241 and one end of the second conductor 1242 are connected to each other. Thermoelectric power differs between the first conductor 1241 and the second conductor 1242. For example, the first conductor 1241 and the second conductor 1242 include a tungsten-rhenium alloy, and the first conductor 1241 includes 5 mass % of rhenium and 95 mass % of tungsten, while the second conductor 1242 includes 26 mass % of rhenium and 74 mass % of tungsten.

Otherwise, the configuration of the twelfth embodiment is similar to that of the first embodiment.

When manufacturing the latent heat storage 12 according to the twelfth embodiment, a paste for the first conductor 1241 and a paste for the second conductor 1242 are mixed, and a paste part for a thermocouple, having the shape of the thermocouple 1240, is famed by screen printing or the like, for example. Then, the paste part for thermocouple, the ceramic part 130, and the metal part 140 are fired simultaneously by co-firing.

According to the twelfth embodiment, it is possible to obtain effects similar to those obtainable by the first embodiment. In addition, because the thermocouple 1240 is provided, it is possible to easily grasp the state of the metal part 120. For example, in a heat storing process, while the metal part 120 is in a solid state, a temperature indicated by the thermocouple 1240 increases with lapse of time. On the other hand, while the metal part 120 undergoes a phase change from the solid state to a liquid state, the temperature indicated by the thermocouple 1240 stabilizes. Thereafter, when the phase change is completed, the temperature indicated by the thermocouple 1240 increases again with lapse of time. Accordingly, it is possible to easily grasp whether the phase change is started, whether the phase change is continuing, and whether the phase change is completed.

In the latent heat storage, the latent heat cannot be stored even if the metal part, that assumes the liquid state after completion of the phase change, is further heated, and the input energy may be wasted. In contrast, according to the present embodiment, because the completion of the phase change can be detected using the thermocouple 1240, after the phase change is completed for one latent heat storage 12, a waste of thermal energy can be reduced by storing the heat in another latent heat storage 12.

First Modification of Twelfth Embodiment

Figure 23:
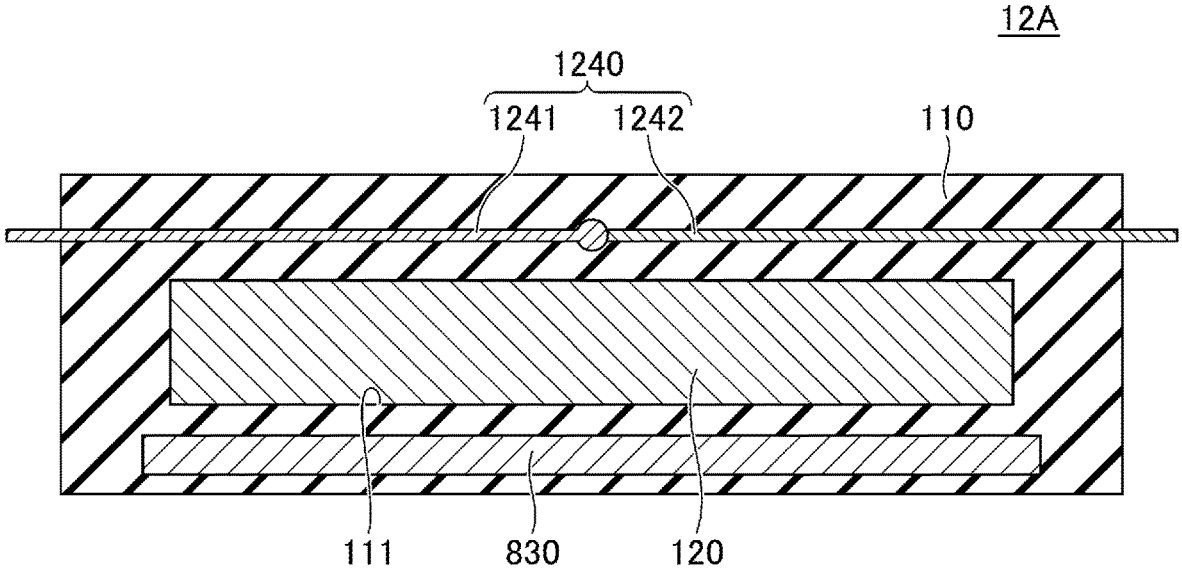
FIG. 23 is a cross sectional view illustrating an example of the latent heat storage according to a first modification of the twelfth embodiment.

A first modification of the twelfth embodiment will be described. FIG. 23 is a cross sectional view illustrating an example of the latent heat storage according to the first modification of the twelfth embodiment.

As illustrated in FIG. 23, a latent heat storage 12A according to the first modification of the twelfth embodiment includes a ceramic part 110 formed of a polycrystalline material, a metal part 120, a thermocouple 1240 that generates an electromotive force (or electric power) by a temperature change in the metal part 120, and a heater element 830 capable of heating the metal part 120. The heater element 830 is provided near one of the pair of largest surfaces of the metal part 120, for example.

Otherwise, the configuration of the first modification of the twelfth embodiment is similar to that of the twelfth embodiment.

According to the first modification of the twelfth embodiment, it is possible to obtain effects similar to those obtainable by the twelfth embodiment. In addition, according to the first modification of the twelfth embodiment, because the latent heat storage 12A includes the heater element 830 similar to the eighth embodiment, it is possible to reduce an energy loss.

Second Modification of Twelfth Embodiment

Figure 24:
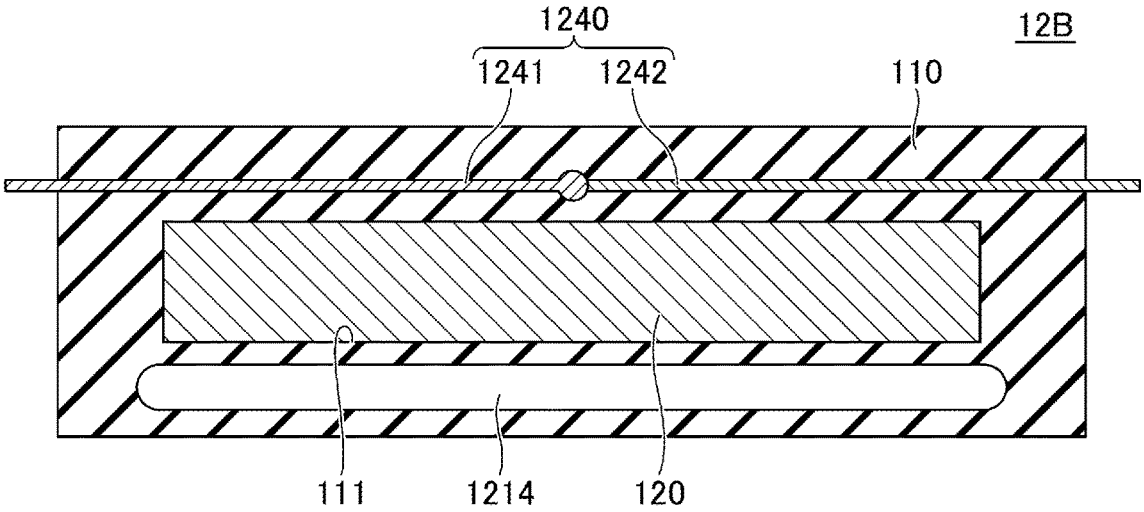
FIG. 24 is a cross sectional view illustrating an example of the latent heat storage according to a second modification of the twelfth embodiment.

A second modification of the twelfth embodiment will be described. FIG. 24 is a cross sectional view illustrating an example of the latent heat storage according to a second modification of the twelfth embodiment.

As illustrated in FIG. 24, in a latent heat storage 12B according to the second modification of the twelfth embodiment, a flow path 1214 through which a heating medium flows is formed in the ceramic part 110.

According to the second modification of the twelfth embodiment, it is possible to obtain effects similar to those obtainable by the twelfth embodiment. In addition, because the flow path 1214 is formed, it is possible to improve a heat exchange efficiency between the heating medium flowing through the flow path 1214 and the metal part 120.

Thirteenth Embodiment

Figure 25:
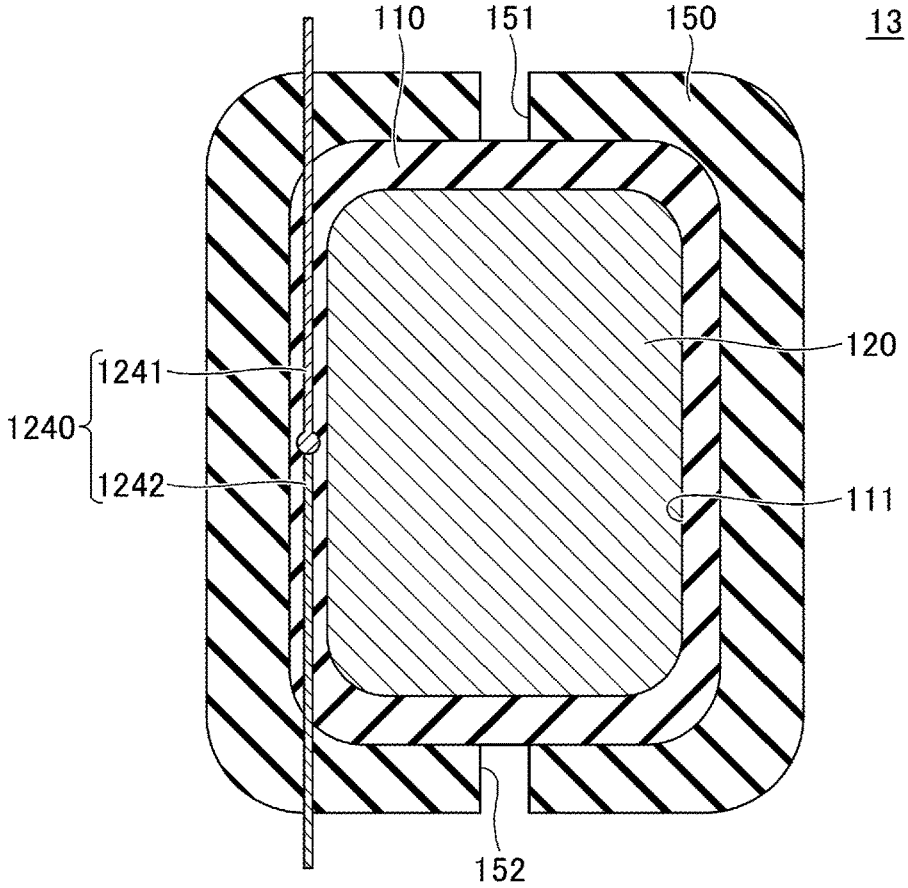
FIG. 25 is a cross sectional view illustrating an example of the latent heat storage according to a thirteenth embodiment.

A thirteenth embodiment described hereunder relates to a latent heat storage, and corresponds to an application example of the twelfth embodiment. FIG. 25 is a cross sectional view illustrating an example of the latent heat storage according to a thirteenth embodiment.

As illustrated in FIG. 25, a latent heat storage 13 according to the thirteenth embodiment includes a ceramic part 110 formed of a polycrystalline material, a metal part 120, a thermocouple 1240 that generates an electromotive force (or electric power) by a temperature change in the metal part 120, and a heat insulating container 150. The ceramic part 110 is accommodated inside the heat insulating container 150. The heat insulating container 150 is provided with a heat inlet port 151 and a heat outlet port 152.

Figure 26A:
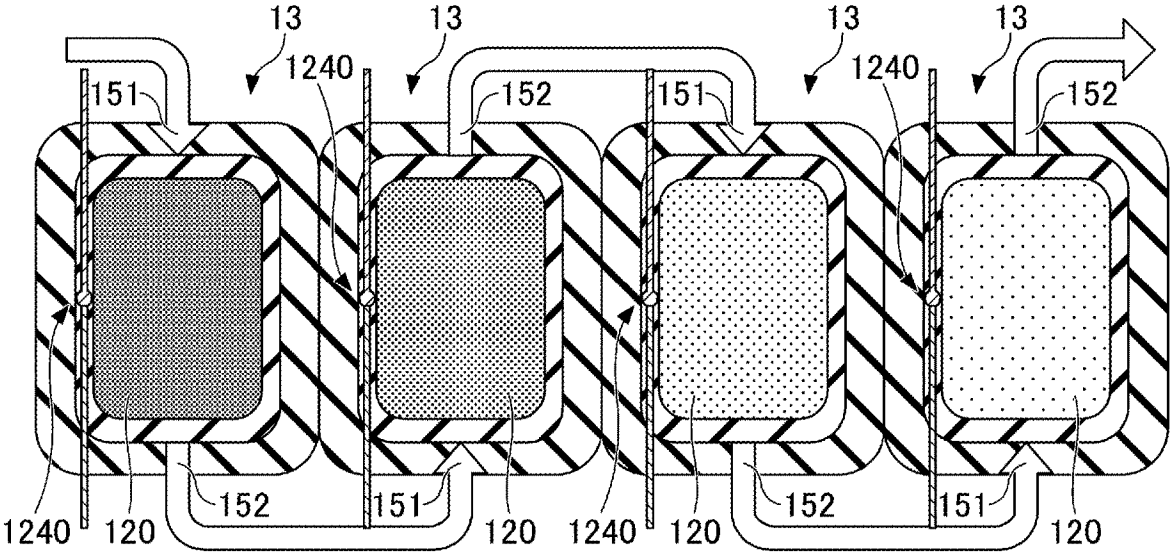
FIG. 26A and FIG. 26B are diagrams illustrating an example of the method for using the latent heat storage according to the thirteenth embodiment.
Figure 26B:
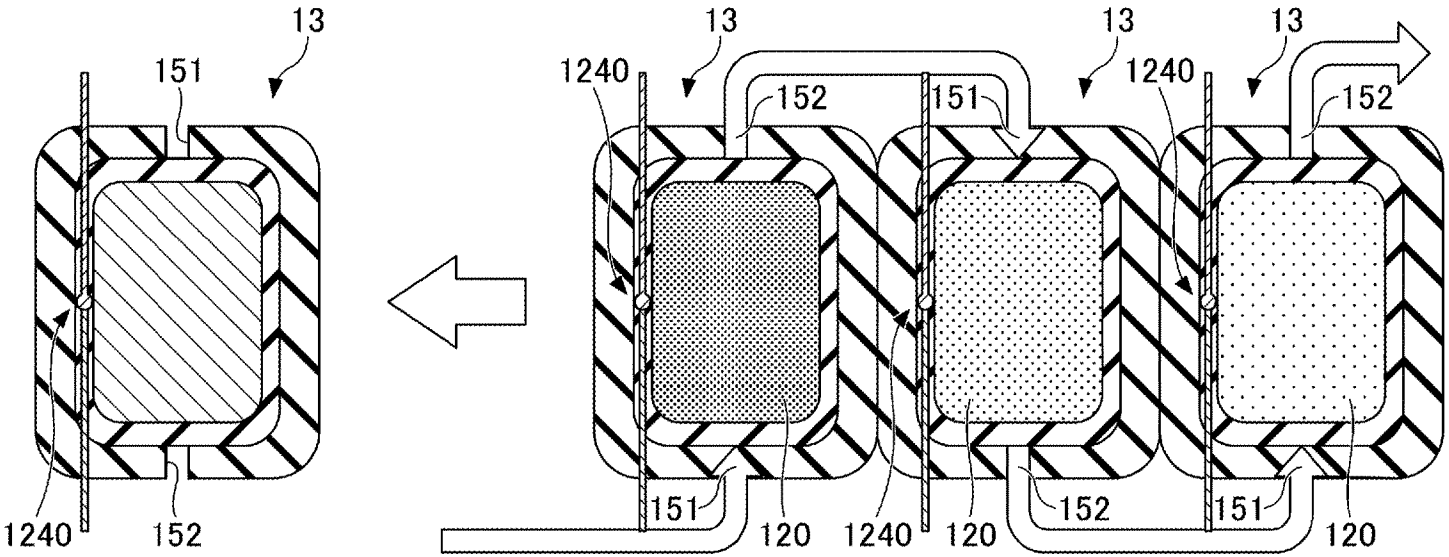

Next, an example of a method for using the latent heat storage 13 according to the thirteenth embodiment will be described. FIG. 26A and FIG. 26B are diagrams illustrating an example of the method for using the latent heat storage 13 according to the thirteenth embodiment. In FIG. 26A and FIG. 26B, halftone is used to indicate a temperature of the metal part 120, and the darker the halftone is, the higher the temperature is.

In this example, as illustrated in FIG. 26A, a plurality of latent heat storages 13 is used. Among the plurality of latent heat storages 13, the inlet ports 151 and the outlet ports 152 are alternately and directly connected to one another to confiture a heat transfer system (series-connected system). For example, the outlet port 152 of one latent heat storage 13 in a first stage is directly connected to the inlet port 151 of the adjacent latent heat storage 13 in a next, second stage. The temperature of the metal parts 120 decreases from the latent heat storage 13 connected at the stage on a most upstream side of the heat transfer toward a downstream side of the heat transfer. In each of the plurality of latent heat storages 13, the phase change state of the metal part 120 can be detected using the thermocouple 1240.

When the completion of the phase change is detected in the latent heat storage 13 at the stage on the most upstream side, as illustrated in FIG. 26B, this latent heat storage 13 is separated from the heat transfer system, and the heat is stored as it is in the separated latent heat storage 13, or the separated latent heat storage 13 is used for an application requiring the use of the heat stored therein. In a case where the heat is stored as it is in the separated latent heat storage 13, it is preferable to close the inlet port 151 and the outlet port 152. On the other hand, heat is made to flow directly into the latent heat storage 13 at the stage on the second most upstream side, and this latent heat storage 13 is used as the new latent heat storage 13 on the most upstream side. Thereafter, although not illustrated, the latent heat storages 13 in which the completion of the phase change is detected are successively separated from the heat transfer system.

According to the thirteenth embodiment, heat can be stored in the plurality of latent heat storages 13, while reducing the waste of thermal energy.

Accordingly to each of the embodiments and modifications described above, it is possible to improve the stability of the latent heat storage.

Various aspects of the subject-matter described herein may be set out non-exhaustively in the following numbered clauses:

1. A method for manufacturing a latent heat storage, comprising:
   preparing a complex body having a metal part that includes copper, and an unfired ceramic part accommodating the metal part; and simultaneously firing the metal part and the ceramic part.

2. The method for manufacturing the latent heat storage according to clause 1, wherein the metal part includes titanium.

3. The method for manufacturing the latent heat storage according to clause 1 or 2, wherein the metal part includes copper at a proportion greater than or equal to 99 mass %.

4. The method for manufacturing the latent heat storage according to clause 1 or 2, wherein the ceramic part includes one of
   aluminum oxide at a proportion greater than or equal to 90 mass %,
   mullite at a proportion greater than or equal to 90 mass %,
   aluminum nitride at a proportion greater than or equal to 95 mass %, and
   a mixture of aluminum nitride and boron nitride at a proportion greater than or equal to 95 mass %.

Although the embodiments and the modifications are numbered with, for example, "first," "second," or the like, the ordinal numbers do not imply priorities of the embodiments and the modifications. Many other variations and modifications will be apparent to those skilled in the art.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A latent heat storage comprising:
   a ceramic part, formed of a polycrystalline material, and including a closed space formed therein;
   a metal part provided inside the closed space, and including copper; and
   a heater, embedded in the ceramic part, and configured to heat the metal part via the ceramic part, wherein:
   the ceramic part is monolithic, and
   the ceramic part includes one of
      aluminum oxide at a proportion greater than or equal to 90 mass %,
      mullite at a proportion greater than or equal to 90 mass %,
      aluminum nitride at a proportion greater than or equal to 95 mass %, and
      a mixture of aluminum nitride and boron nitride at a proportion greater than or equal to 95 mass %.

2. The latent heat storage as claimed in claim 1, wherein a volume of the closed space is larger than a volume of the metal part.

3. The latent heat storage as claimed in claim 2, wherein a volume of the closed space at 25° C. is in a range greater than or equal to 112% and less than or equal to 120% of a volume of the metal part.

4. The latent heat storage as claimed in claim 1, wherein the metal part includes copper at a proportion greater than or equal to 99 mass %.

5. The latent heat storage as claimed in claim 1, wherein
   the ceramic part has a tubular shape including an inner wall surface and an outer wall surface, and
   the closed space and the metal part have a spiral shape along the inner wall surface and the outer wall surface.

6. The latent heat storage as claimed in claim 1, comprising:
   a plurality of pairs of the closed space and the metal part, wherein
   the ceramic part is formed with a plurality of through holes extending in a first direction, and
   the closed space and the metal part have a columnar shape parallel to the first direction.

7. The latent heat storage as claimed in claim 1, wherein
   the ceramic part is formed with a plurality of through holes extending in a first direction, and
   the closed space and the metal part have a bellows shape extending in a second direction perpendicular to the first direction.

8. The latent heat storage as claimed in claim 1, wherein
   the ceramic part is formed with a plurality of through holes extending in a first direction, and
   the closed space and the metal part have a bellows shape extending in the first direction.

9. The latent heat storage as claimed in claim 1, wherein titanium is present between the metal part and the ceramic part.

10. The latent heat storage as claimed in claim 9, wherein a mass of the titanium is in a range greater than 0% and less than or equal to 10% of a mass of the metal part.

11. The latent heat storage as claimed in claim 1, wherein the heater includes a mixture of tungsten and aluminum oxide, or a mixture of molybdenum and aluminum oxide.

12. The latent heat storage as claimed in claim 1, wherein the heater includes one of molybdenum disilicide, ruthenium oxide, a nickel-chromium alloy, and a silver-palladium alloy.

13. The latent heat storage as claimed in claim 12, wherein the heater further includes glass.

14. The latent heat storage as claimed in claim 1, further comprising:
   a thermocouple configured to generate an electromotive force by a temperature change in the metal part.

15. The latent heat storage as claimed in claim 14, wherein the thermocouple is provided within the ceramic part.

16. The latent heat storage as claimed in claim 14, wherein the thermocouple is provided on a surface of the ceramic part.

17. The latent heat storage as claimed in claim 14, wherein the thermocouple includes a tungsten-rhenium alloy.

18. The latent heat storage as claimed in claim 14, wherein the ceramic part has a flow path through which a heating medium flows.

19. The latent heat storage as claimed in claim 1, wherein:
   the ceramic part has a cylindrical shape with a through hole, the metal part has a columnar shape and is provided inside the through hole, and the heater embedded in the ceramic part has a shape extending along the columnar shape of the metal part.

20. The latent heat storage as claimed in claim 19, wherein the heater has a spiral shape alternately repeating a clockwise turn and a counterclockwise turn when viewed from a direction parallel to a longitudinal axis of the columnar shape of the metal part.

* * * * *